US006534911B1

(12) United States Patent
Ando

(10) Patent No.: US 6,534,911 B1
(45) Date of Patent: Mar. 18, 2003

(54) ELECTRON BEAM DEVICE

(75) Inventor: Yoichi Ando, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/722,702

(22) Filed: Nov. 28, 2000

Related U.S. Application Data

(63) Continuation of application No. PCT/JP00/00409, filed on Jan. 27, 2000.

(30) Foreign Application Priority Data

Jan. 28, 1999 (JP) ..... 11-020284

(51) Int. Cl.[7] ..... H01J 1/62
(52) U.S. Cl. ..... 313/496; 313/292
(58) Field of Search ..... 313/496, 238, 313/292, 309, 336, 351, 257

(56) References Cited

U.S. PATENT DOCUMENTS

| | | | | |
|---|---|---|---|---|
| 4,668,438 | A | 5/1987 | Pierr et al. | 260/400 |
| 4,769,575 | A | 9/1988 | Murata et al. | 313/495 |
| 4,904,895 | A | 2/1990 | Tsukamoto et al. | 313/336 |
| 5,066,883 | A | 11/1991 | Yoshioka et al. | 313/309 |
| 5,532,548 | A | 7/1996 | Spindt et al. | 313/422 |
| 5,682,085 | A | 10/1997 | Suzuki et al. | 315/169.1 |
| 5,742,117 | A | 4/1998 | Spindt et al. | 313/422 |
| 6,053,791 | A | 4/2000 | Fujii et al. | 445/6 |

FOREIGN PATENT DOCUMENTS

| | | |
|---|---|---|
| JP | 61-118355 | 6/1986 |
| JP | 61-124031 | 6/1986 |
| JP | 64-31332 | 2/1989 |
| JP | 2-257551 | 10/1990 |
| JP | 4-28137 | 1/1992 |

OTHER PUBLICATIONS

C.A. Mead, "Operation of Tunnel–Emission Devices", Journal of Applied Physics, vol. 32, No. 4, Apr. 1961, pp. 646–652.
C.A. Spindt et al., "Physical Properties of Thin–Film Field Emission Cathodes with Molybdenum Cones", Journal of Applied Physics, vol. 47, Dec. 1976, pp. 5248–5263.
W.P. Dyke et al., "Field Emission", Advances in Electronics and Electron Physics, Academic Press Inc., 1956, pp. 89–185.
R. Meyer, et al., "Recent Development on 'Microtips' Display at Leti", Technical Digest of IVMC 91, Nagahama 1991, pp. 6–9.
M.I. Elinson et al., "The Emission of Hot Electrons and the Field Emission of Electrons from Tin Oxide", Radio Eng. Electron Phys., Jul. 1965, pp. 1290–1296.
G. Ditmer, "Electrical Conduction and Electron Emission of Discontinuous Thin Films", Thin Solid Film, (1972) pp. 317–329.
M. Hartwell et al., "Strong Electron Emission from Patterned Tin–Indium Oxide Thin Films", IEEE Trans. Ed Conf., pp. 519–521 (1975).
H. Araki et al., "Electroforming and Election Emission of Carbon Thin Films", Journal of the Vacuum Society of Japan, vol. 26, No. 1, pp. 22–29 (1983) (with English Abstract on page 22).

*Primary Examiner*—Vip Patel
(74) *Attorney, Agent, or Firm*—Fitzpatrick, Cella, Harper & Scinto

(57) ABSTRACT

An electron beam device comprising an electron source having an electron-emitting device, a member to be irradiated with an electron beam disposed opposite to the electron source, and an electrically conductive spacer disposed between the electron source and the member to be irradiated with the electron beam, is characterized in that an electrode is disposed along an end portion of the spacer on the electron source side, and the electrode is disposed inside a region of a surface of the end portion of the spacer which is directed toward the electron source side.

45 Claims, 23 Drawing Sheets

(a)

(b)

ELECTRON BEAM DEVICE

This application is a continuation of International Application No. PCT/JP00/00409, filed Jan. 27, 2000, which claims the benefit of Japanese Patent Application No. 11-020284, filed Jan. 28, 1999. International Application No. PCT/JP00/00409 was published in Japanese as International Publication No. WO00/45415, on Aug. 3, 2000.

TECHNICAL FIELD

The present invention relates to an electron beam device, and an image forming apparatus, such as a display device which is an application of the electron beam device.

BACKGROUND ART

Up to now, as the electron-emitting devices, there have been known a hot cathode element and a cold cathode element. As the cold cathode element of those elements, there have been known, for example, a surface conduction type electron-emitting device, a field emission element (hereinafter referred as "FE type"), a metal/insulating layer/metal type emission element (hereinafter referred to as "MIM type"), etc.

As the surface conduction type electron-emitting devices, there have been known, for example, an example disclosed in Radio Eng. Electron Phys., 10, 1290 (1965) by M. I. Elinson, or other examples which will be described later.

The surface conduction type emission element utilizes a phenomenon in which electron emission occurs by allowing a current to flow into a small-area thin film formed on a substrate in parallel to a film surface. As the surface conduction type emission element, there have been reported a surface conduction type emission element using an $SnO_2$ thin film by such as the above-mentioned Elinson, a surface conduction type emission element using an Au thin film [G. Dittmer: "Thin Solid Films", 9,317 (1972)], a surface conduction type emission element using an $In_2O_3/SnO_2$ thin film [M. Hartwell an C. G. Fonstad: "IEEE Trans. ED Conf.", 519(1975)], a surface conduction type electron-emitting device using a carbon thin film ["Vapor Vacuum," Vol. 26, No. 1, p 22 (1983), by Hisashi Araki, et al.], etc.

As a typical example of those surface conduction type emission elements, a plan view of the above-mentioned element structure by M. Hartwell and others is shown in FIG. 29. In FIG. 29, reference numeral 3001 denotes a substrate, and reference numeral 3004 denotes an electrically conductive film that is made of a metal oxide formed through sputtering. The electrically conductive film 3004 is formed in an H-shaped plane as shown. An electrifying process called "electrification forming" which will be described later is conducted on the electrically conductive thin film 3004 to form an electron emission portion 3005. In FIG. 29, an interval L is set to 0.5 to 1 [mm], and W is set to 0.1 [mm]. For convenience of showing in the figure, the electron emission portion 3005 is shaped in a rectangle in the center of the electrically conductive thin film 3004. However, this shape is schematic and does not faithfully express the position and the configuration of the actual electron emission portion.

In the above-mentioned surface conduction type emission elements including the element proposed by M. Hartwell, et al., the electron emission portion 3005 is generally formed on the electrically conductive film 3004 through the electrifying process which is called "electrification forming" before the electron emission is conducted. In other words, the electrification forming is directed to a process in which a constant d.c. voltage or a d.c. voltage that steps up at a very slow rate for example about 1 V/min is applied to both ends of the electrically conducive film 3004 so that the electrically conductive film 3004 is electrified, to thereby locally destroy, deform or affect the electrically conductive film 3004, thus forming the electron emission portion 3005 which is in an electrically high resistant state. A crack occurs in a part of the electrically conductive film 3004 which has been locally destroyed, deformed or affected. In the case where an appropriate voltage is applied to the electrically conductive thin film 3004 after the above electrification forming, electrons are emitted from a portion close to the crack.

Examples of the FE type have been known from "Field Emission" of Advance in Electron Physics, 8, 89 (1956) by W. P. Dyke and W. W. Dolan, "Physical Properties of Thin-Film Field Emission Cathodes with Molybdenum cones" of J. Appl. Phys., 47,5248 (1976), by C. A. Spindt, etc.

As a typical example of the element structure of the FE element, FIG. 30 shows a cross-sectional view of the elements made by the above-mentioned C. A. Spindt, et al. In this figure, reference numeral 3010 denotes a substrate, 3011 is an emitter wiring made of an electrically conductive material, 3012 is an emitter cone, 3013 is an insulating layer, and 3014 is a gate electrode. The element of this type is so designed as to apply an appropriate voltage between the emitter cone 3012 and the gate electrode 3014 to produce electric field emission from a tip portion of the emitter cone 3012.

Also, as another element structure of the FE type, there is an example in which an emitter and a gate electrode are disposed on a substrate substantially in parallel with the substrate plane without using a laminate structure shown in FIG. 30.

Also, as an example of the MIM type, there has been known, for example, "Operation of Tunnel-Emission Devices," J. Appl. Phys., 32,646 (1961) by C. A. Mead, etc. A typical example of the element structure of the MIM type is shown in FIG. 31. FIG. 31 is a cross-sectional view, and in the figure, reference numeral 3020 denotes a substrate, 3021 is a lower electrode made of metal, 3022 is a thin insulating layer about 100 [Å] in thickness, and 3023 is an upper electrode made of metal about 80 to 300 [Å] in thickness. In the MIM type, an appropriate voltage is applied between the upper electrode 3023 and the lower electrode 3021, to thereby produce electron emission from the surface of the upper electrode 3023.

The above-mentioned cold cathode element does not require a heater for heating because it can obtain electron emission at a low temperature as compared with the hot cathode element. Accordingly, the cold cathode element is simpler in structure than the hot cathode element and can prepare a fine element. Also, in the cold cathode element, even if a large number of elements are disposed on the substrate with a high density, a problem such as heat melting of the substrate is difficult to occur. Further, the cold cathode element is advantageous in that a response speed is high which is different from the heat cathode element which is low in the response speed because it operates due to heating by the heater.

For the above-mentioned reasons, a study for applying the cold cathode elements has been extensively conducted.

For example, the surface conduction type emission element has the advantage that a large number of elements can be formed on a large area since it is particularly simple in structure and also easy to manufacture among the cold cathode elements. For that reason, a method in which a large number of elements are arranged and driven has been studied for example, as disclosed in JP-A-64-31332 by the present applicant.

Also, as the application of the surface conduction type emission element, for example, an image display device, an image forming apparatus such as an image recording device, a charge beam source, and so on have been studied. In particular, as the application to the image display device, there has been studied an image display device using the combination of the surface conduction type emission element with a phosphor that emits light by irradiation of an electron beam as disclosed in for example U.S. Pat. No. 5,066,883 by the present applicant, JP-A-2-257551, and JP-A-4-28137. In the image display device using the combination of the surface conduction type electron-emitting device with the phosphor, the characteristic superior to the conventional other image display devices is expected. For example, even as compared with the liquid crystal display device which has been spread in recent years, the above image display device is excellent in that no back light is required because it is of the self light emitting type and the angle of visibility is broad.

Also, a method in which a large number of FE type elements are disposed and driven is disclosed in, for example, U.S. Pat. No. 4,904,895 by the present applicant. Also, as an example of applying the FE type to the image display device, there has been known, for example, a plate type image display device reported by R. Meyer, etc. [R. Meyer: "Recent Development on Micro-Tips Display at LETI", Tech. Digest of 4th Int. Vacuum Microelectronics Conf., Nagahama, pp. 6 to 9 (1991)].

Also, an example in which a large number of MIM type elements are arranged and applied to an image display device is disclosed in, for example, JP-A-3-55738 by the present applicant.

Among the image forming apparatuses using the above-mentioned emission element, attention has been paid to the flat type image display device thin in depthwise as a replacement of the CRT type image display device since the space is saved and the weight is light.

FIG. 32 is a perspective view showing an example of a display panel portion which forms a plane-type image display device, in which a part of the panel is cut off in order to show the internal structure.

In FIG. 32, reference numeral 3115 denotes a rear plate, 3116 a side wall, 3117 a face plate, and the rear plate 3115, the side wall 3116 and the face plate 3117 form an envelope (airtight vessel) for maintaining the interior of the display panel in a vacuum state.

The rear plate 3115 is fixed with a substrate 3111, and N×M cold cathode elements 3112 are formed on the substrate 3111 (N and M are positive integers of equal to or larger than 2 or more and appropriately set in accordance with the target number of display pixels). Also, the N×M cold cathode elements 3112 are wired by M row wirings 3113 and N column wirings 3114 as shown in FIG. 32. A portion made up of the substrate 3111, the cold cathode elements 3112, the row wirings 3113 and the column wirings 3114 is called "multiple electron beam source". Also, at least in portions where the row wirings 3113 and the column wirings 3114 cross each other, an insulating layer (not shown) between both of the wirings is formed to keep electric insulation.

A lower surface of the face plate 3117 is formed with a fluorescent film 3118 formed of a phosphor on which phosphors (not shown) of three primary colors consisting of red (R), green (G) and blue (B) are separately painted. Also, black material (not shown) are disposed between the respective color phosphors which form the fluorescent film 3118, and further a metal back 3119 made of Al or the like is formed on a surface of the fluorescent film 3118 on the rear plate 3115 side.

Dx1 to Dxm and Dy1 to Dyn and Hv are electric connection terminals with an airtight structure provided for electrically connecting the display panel to an electric circuit not shown. Dx1 to Dxm are electrically connected to the row wirings 3113 of the multiple electron beam source, Dy1 to Dyn are electrically connected to the column wirings 3114 of the multiple electron beam source, and Hv is electrically connected to the metal back 3119, respectively.

Also, the interior of the above airtight vessel is maintained in a vacuum state of about $10^{-6}$ Torr, and there is required means for preventing the deformation or destruction of the rear plate 3115 and the face plate 3117 due to a pressure difference between the interior of the airtight vessel and the external, as a display area of the image display device increases. In a method of thickening the rear plate 3115 and the face plate 3116, not only does the weight of the image display device increase, but also a distortion of an image or a parallax occurs when viewing the display device from an oblique direction. On the contrary, in FIG. 32, there is provided a structure support (called "spacer" or "rib") 3120 which is formed of a relatively thin glass substrate for supporting the atmospheric pressure. With this structure, a space of normally sub mm to several mm is kept between the substrate 3111 on which the multiple beam electron source is formed and the face plate 3117 on which the fluorescent film 3118 is formed, and the interior of the airtight vessel is maintained in a high vacuum state as described above.

In the image display device using the display panel as described above, when a voltage is applied to the respective cold cathode elements 3112 through the vessel external terminals Dx1 to Dxm and Dy1 to Dyn, electrons are emitted from the respective cold elements 3112. At the same time, with the application of a high voltage of several hundreds [V] to several [kV] to the metal back 3119 through the vessel external terminal Hv, the above emitted electrons are accelerated and made to collide with an inner surface of the face plate 3117. As a result, the phosphors of the respective colors which form the fluorescent film 3118 are excited and emit light, thus displaying an image.

The display panel of the above-described image display device suffers from the following problems.

Because a high voltage of several hundreds V or more (that is, a high electric field of 1 kV/mm or more) is applied between the multiple beam electron source and the face plate 3117 in order to accelerate the emitted electrons from the cold cathode elements 3112, there is a fear that a creeping discharge occurs on the surface of the spacer 3120. In particular, in the case where the spacer electric charge is produced by hitting parts of electrons emitted from the vicinity of the spacer 3120 to the spacer or sticking ions ionized by the action of the emitted electrons onto the spacer, there is the possibility that discharge is induced.

In order to solve the above problem, there has been proposed that a fine current is permitted to flow in the spacer to remove electric charge (JP-A-61-118355 and JP-A-61-124031). In the proposal, a high resistant thin film is formed on a surface of the insulating spacer as, to thereby allow the fine current to flow on the surface of the spacer. The high resistant film used in this proposal is formed of a tin oxide film, a mixed crystal thin film of tin oxide and indium oxide, or a metal film.

In order to further enhance the function of the high resistant film, an electrically conductive film is disposed on a surface of the spacer 3120 which is in contact with the substrate 3111 or the fluorescent film 3118 and in the vicinity of that surface. As a result, electric connections between the high resistant film and the substrate 3111 and the fluorescence film 3118 are ensured.

On the other hand, when a high voltage is applied between the substrate 3111 and the fluorescent film 3118, the above electrically conductive film is liable to become cause of the discharge. The discharge suddenly occurs during image display, resulting in such problems that not only the image is disturbed, but also the cold cathode element 3112 in the vicinity of the discharge portion is remarkably deteriorated, thereby being incapable of normally displaying the image after that.

The present invention has been made to overcome the above drawback of the conventional spacer, and therefore an object of the present invention is to provide an image display device which prevents discharge during image display, thereby being capable of obtaining an excellent display image.

DISCLOSURE OF THE INVENTION

An electron beam device in accordance with one aspect of the present invention is structured as follows:

An electron beam device comprising: an electron source having an electron-emitting device; a member to be irradiated with an electron beam is irradiated which is disposed opposite to the electron source; and an electrically conductive spacer disposed between the electron source and the member to be irradiated with the electron beam; characterized in that an electrode is disposed along an end portion of the spacer on the electron source side, and the electrode is disposed inside a region of a surface of the end portion of the spacer which is directed toward the electron source side.

The electrode disposed along the end portion of the spacer allows the unevenness of the potential of the spacer to be uniformed, and a region at which the electrode is positioned is located inside a region of an abutting surface of the spacer with the electron source side, thereby being capable of suppressing the discharge from the electrode. It is preferable that the electrode along the end portion of the spacer is disposed along the longitudinal direction of the spacer when the longitudinal direction of the spacer is in a direction substantially orthogonal to a normal of the substrate surface of the electron source.

In this example, it is better that the spacer is electrically connected to the electrode disposed on the member to be irradiated with the electron beam. It is preferable that the spacer is positioned on the electrode disposed on the member to be irradiated with the electron beam. In this case, the electrode disposed on the member to which the electrode beam is irradiated is directed to, for example, an electrode to which a potential that controls the emitted electrons is given, and more specifically, for example, an electrode to which a potential that accelerates the emitted electrons is given.

An electron beam device in accordance with another aspect of the present invention is structured as follows:

An electron beam device comprising: an electron source having an electron-emitting device; a control electrode disposed opposite to the electron source, to which a potential that controls electrons emitted from the electron source is given; and an electrically conductive spacer disposed between the electron source and the control electrode, characterized in that an electrode is disposed along an end portion of the spacer on the electron source side, and the electrode is disposed inside a region of a surface of the end portion of the spacer which is directed toward the electron source side.

In the respective aspects of the present invention, it is better that the spacer is electrically connected to the electrode disposed on the electron source. It is preferable that the spacer is positioned on the electrode disposed on the electron source. The electrode on the electron source can be variously structured, and may be formed of, for example, a wiring disposed on the electron source. In particular, a wiring that gives a potential that drives the electron-emitting device of the electron source can be employed.

Also, in the above-described respective inventions, the electrode along the end portion of the spacer may be preferably formed of an electrode disposed on the spacer. More preferably, the electrode along the end portion of the spacer may be formed of a low resistant film coated on the spacer.

A joining material positioned along the end portion of the spacer which fixes the spacer to the electron source side may be preferably disposed inside the region of a surface of the end portion of the spacer which is directed toward the electron source side.

In order to electrically connect the spacer to the electrode disposed on the electron source, the low resistant film and/or the joining material which is the electrode disposed on the spacer may be preferably electrically connected to the electrode disposed on the electron source.

The above description is given of the electrode along the end portion of the electron source side. The same is applicable to an electrode disposed along the side of the member to be irradiated with the electron beam or the control electrode side such as an accelerating electrode of the spacer.

Also, the electric conductivity of the spacer may be preferably produced by the electrically conductive film of the spacer.

In particular, it is preferable that the spacer has the electrically conductive film, and the electrically conductive film is electrically connected to the electrode along the end portion of the spacer.

The spacer has the electrically conductive film, and the electrically conductive film is brought in contact with the electrode along the end portion of the spacer, thereby being capable of electrically connecting the electrically conductive film and the electrode disposed along the end portion of the spacer. In particular, it is preferable that the electrically conductive film and the electrode disposed along the end portion of the spacer are laminated one on another.

Also, it is preferable that the electrically conductive film is disposed on a base material that constitutes the spacer. In this example, it is preferable that the base material is high in insulating property from the viewpoint of suppressing the electric conductivity of the spacer from becoming too high. Also, it is preferable that the electrically conductive film is $10^5$ Ω/square to $10^{14}$ Ω/square in order to suppress the electric charge or an influence of the electric charge on the orbit of electrons. It is preferable that the electrode disposed along the end portion of the spacer higher in electric conductivity than the electrically conductive film is used.

Also, in the above-described respective aspects of the present invention, the electron source can be particularly preferably applied to a case in which a plurality of electron-emitting devices are provided. Further, it is particularly preferable that the plurality of electron-emitting devices are wired in a matrix by a plurality of row-directional wirings and a plurality of column-directional wirings extending in a direction crossing the row-directional wirings.

Also, it is preferable that the electron-emitting device is formed of a cold cathode element. In particular, the above-described present invention can be preferably applied in a case in which the electron-emitting device is formed of a surface conduction type emission element.

Further, the present application includes, as the invention of an image forming apparatus, the invention of an image forming apparatus characterized in that there is provided a target onto which electrons emitted from the electron-emitting device are irradiated, and the electrons are irradiated onto the target to form an image in the above-described electron beam device. In particular, it is preferable that the target is formed of a phosphor.

Figure 18:
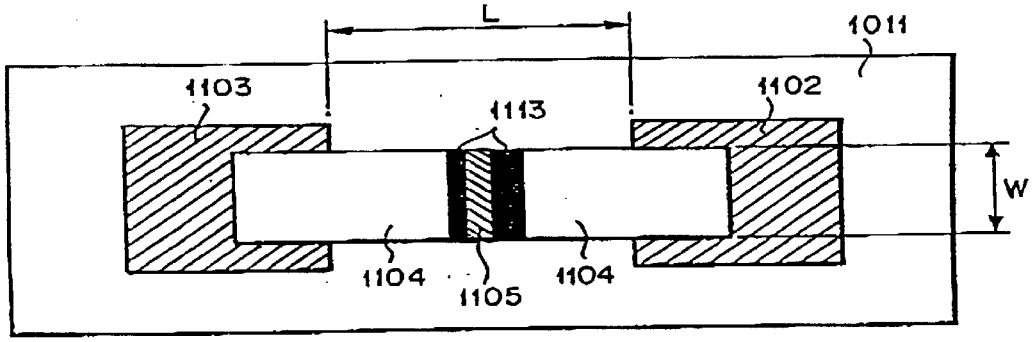
Figure 18:
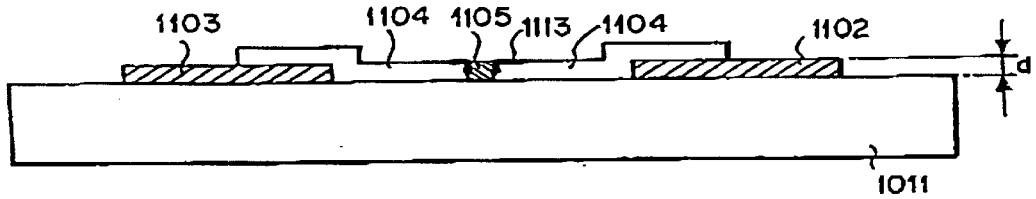

(*a*) of FIG. 18 is a plan view showing a plane type surface conduction type emission element substrate in accordance with an embodiment of the present invention.

(*b*) of FIG. 18 is a cross-sectional view showing the plane type surface conduction type emission element substrate in accordance with the embodiment of the present invention.

Figure 19:
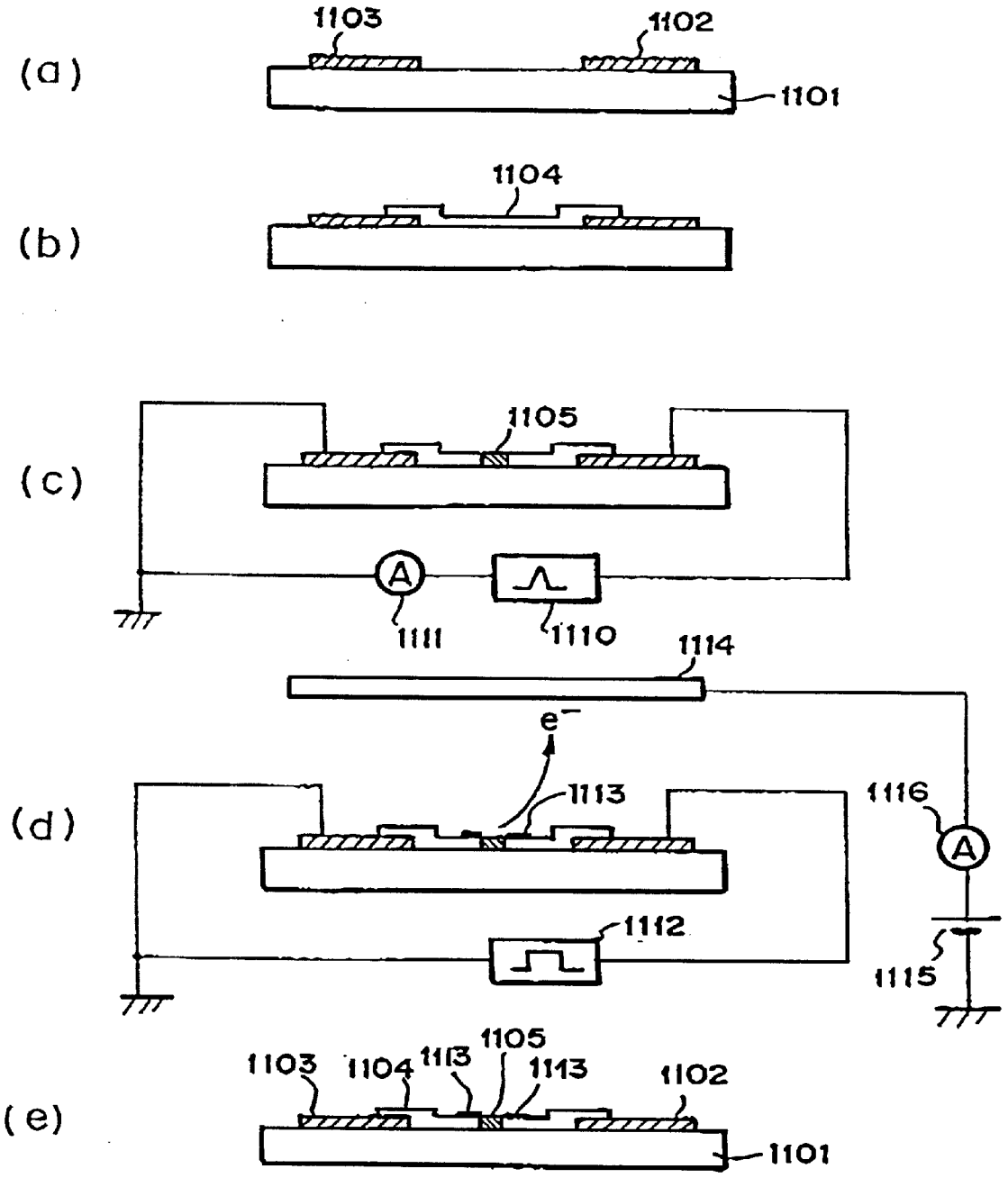

(*a*) to (*e*) of FIG. 19 are cross-sectional views showing a process of manufacturing the plane type surface conduction type emission element shown in FIGS. 18(*a*) and 18(*b*) in accordance with the embodiment of the present invention.

Figure 20:
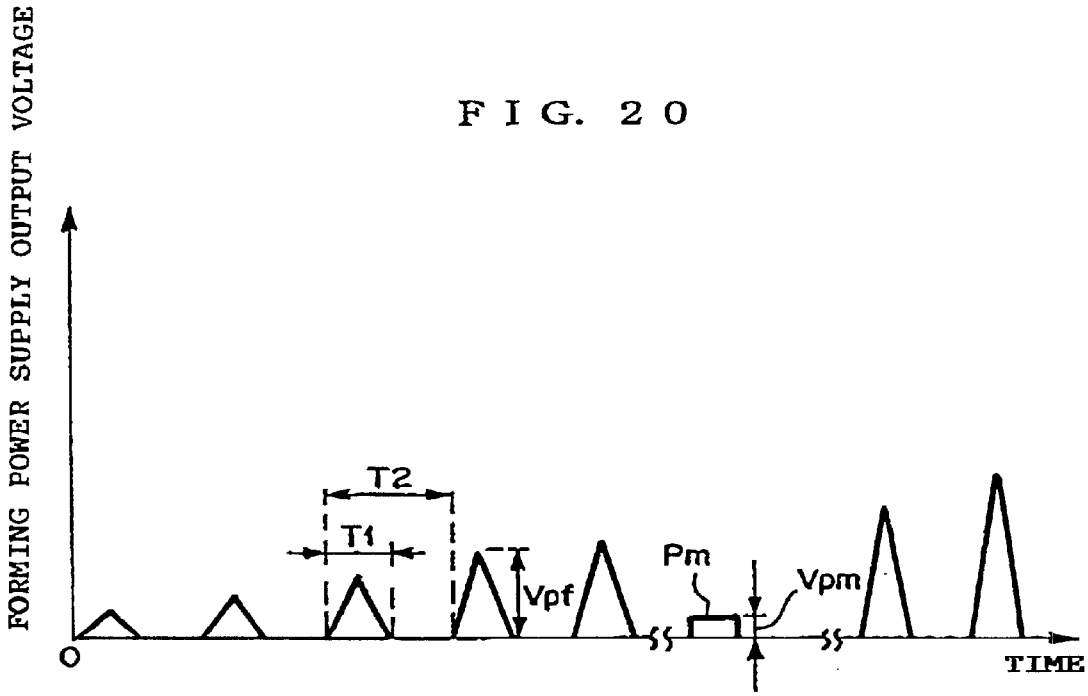

FIG. 20 is a graph showing a supply voltage waveform in conducting an electrification forming process shown in (*c*) of FIG. 19.

Figure 21:
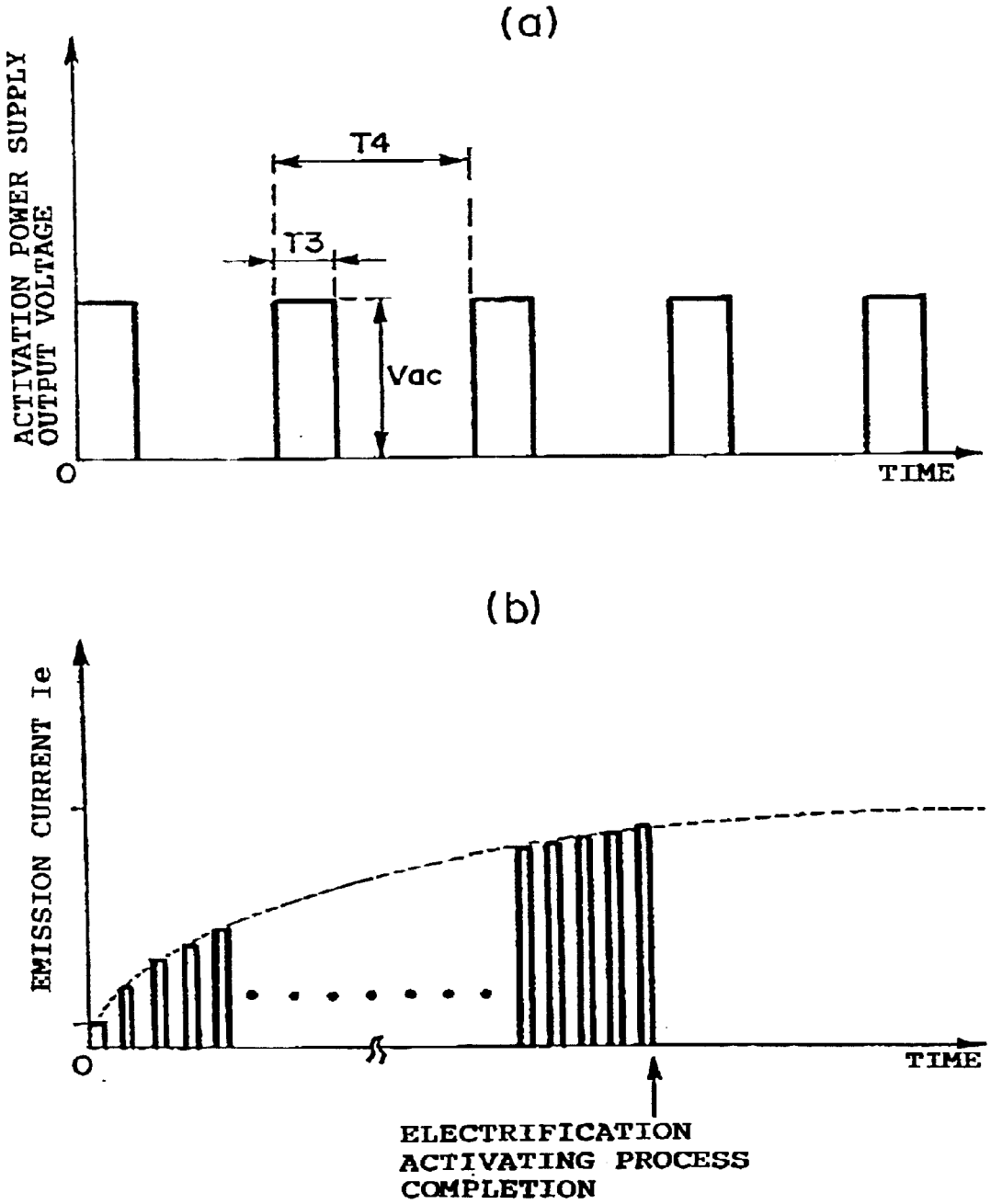

(*a*) of FIG. 21 is a graph showing a supply voltage waveform in conducting an electrification activating process shown in (*d*) of FIG. 19.

(*b*) of FIG. 21 is a graph showing a change in an emission current Ie in conducting the electrification activating process shown in (*d*) of FIG. 19.

Figure 22:
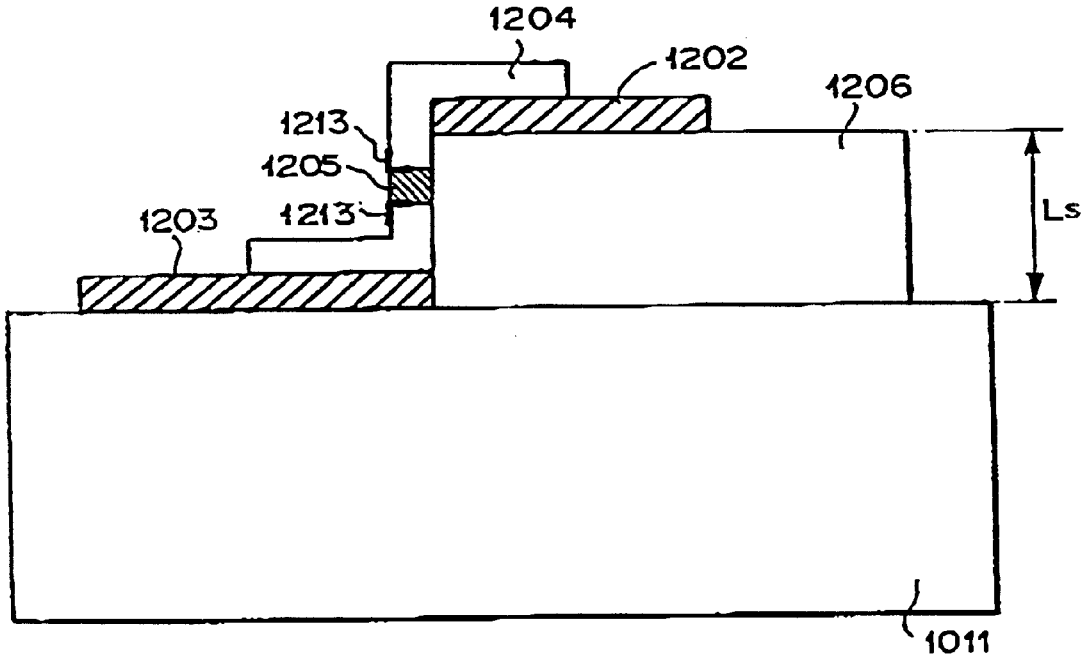

FIG. 22 is a cross-sectional view showing a vertical-type surface conduction type emission element in accordance with an embodiment of the present invention.

Figure 23:
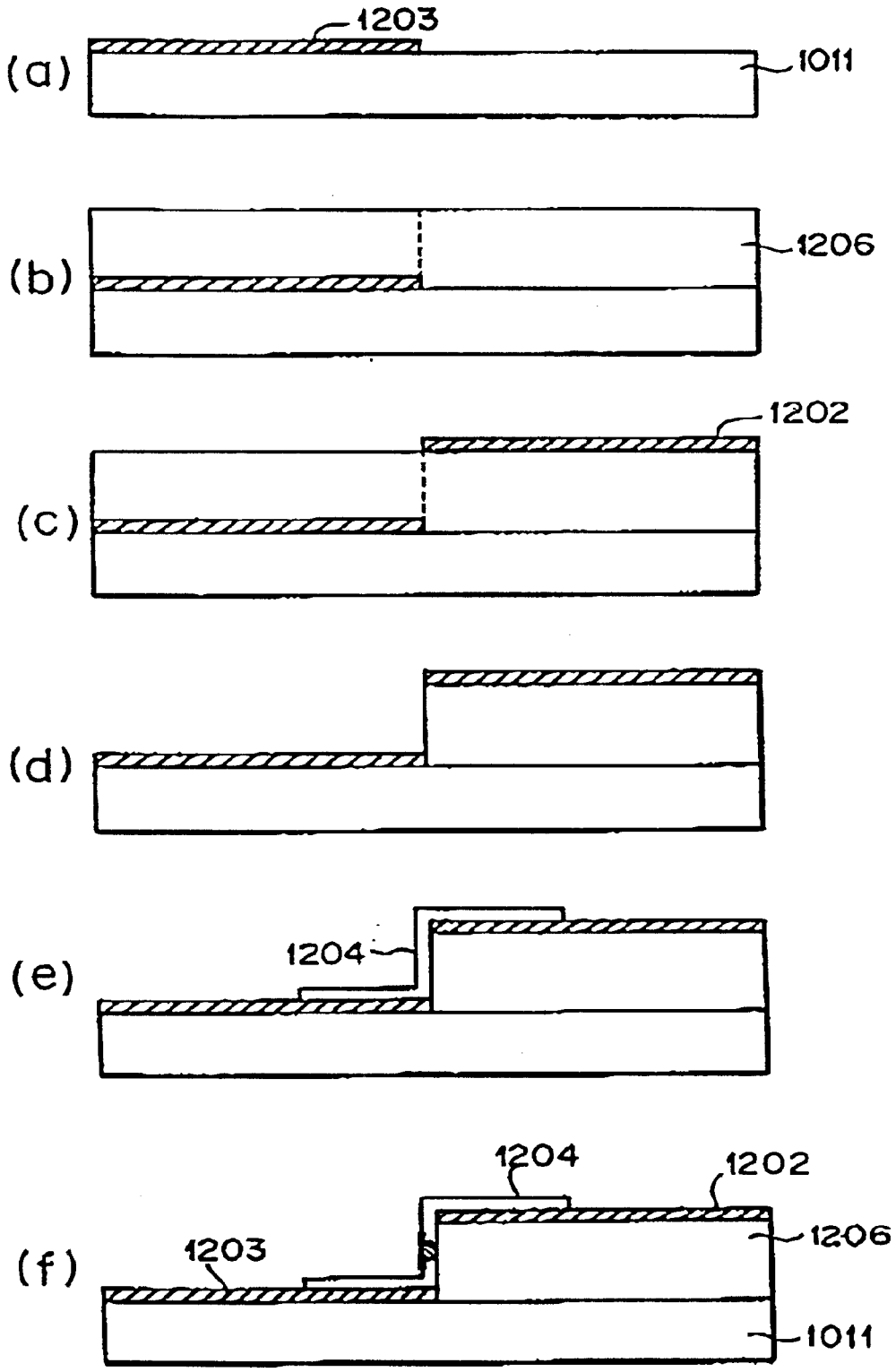

(*a*) to (*f*) of FIG. 23 are cross-sectional views showing a process of manufacturing the vertical-type surface conduction type emission element shown in FIG. 22 in accordance with the embodiment of the present invention.

Figure 24:
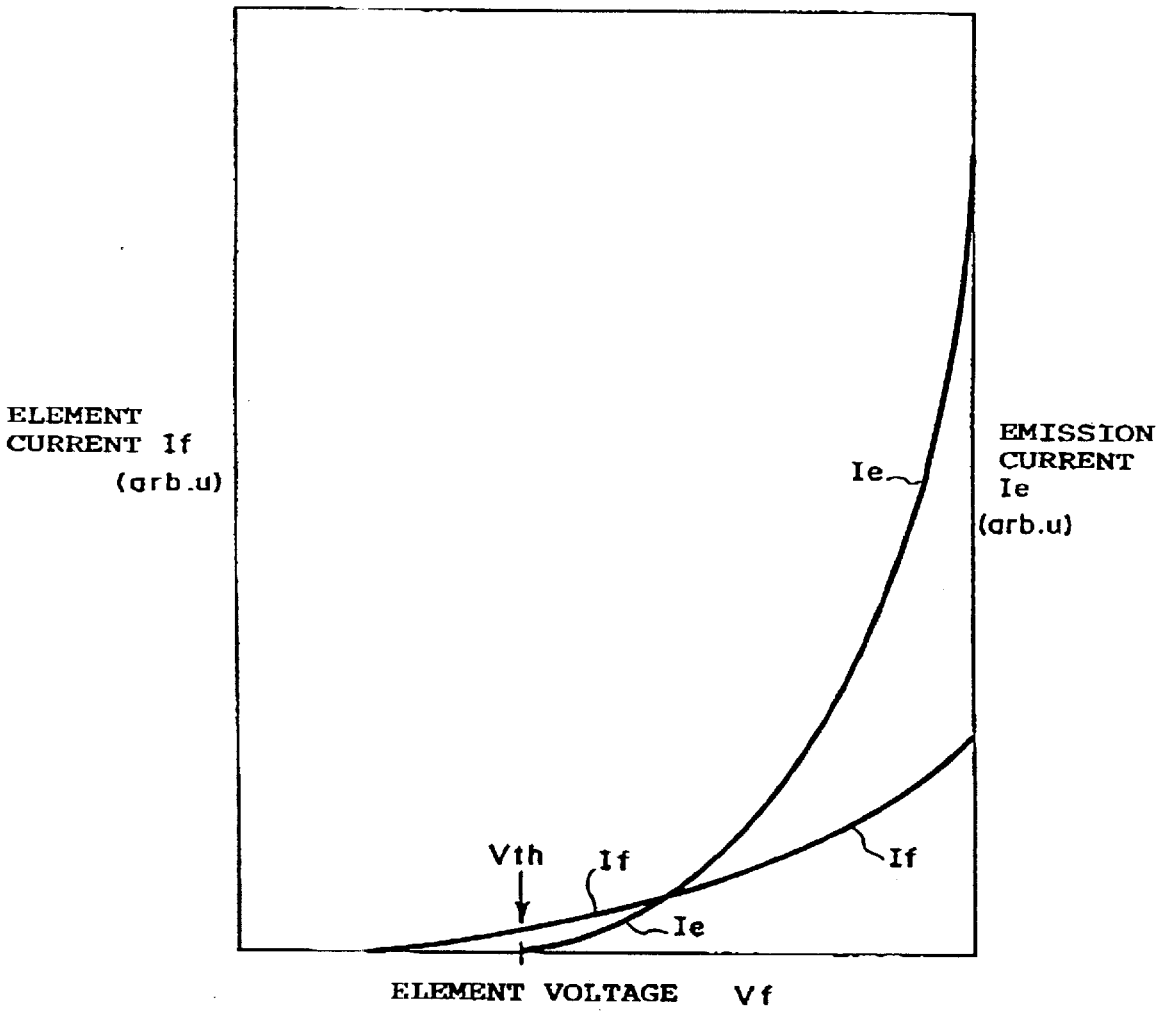

FIG. 24 is a graph showing the typical characteristic of the surface conduction type emission element in accordance with the embodiment of the present invention.

Figure 25:
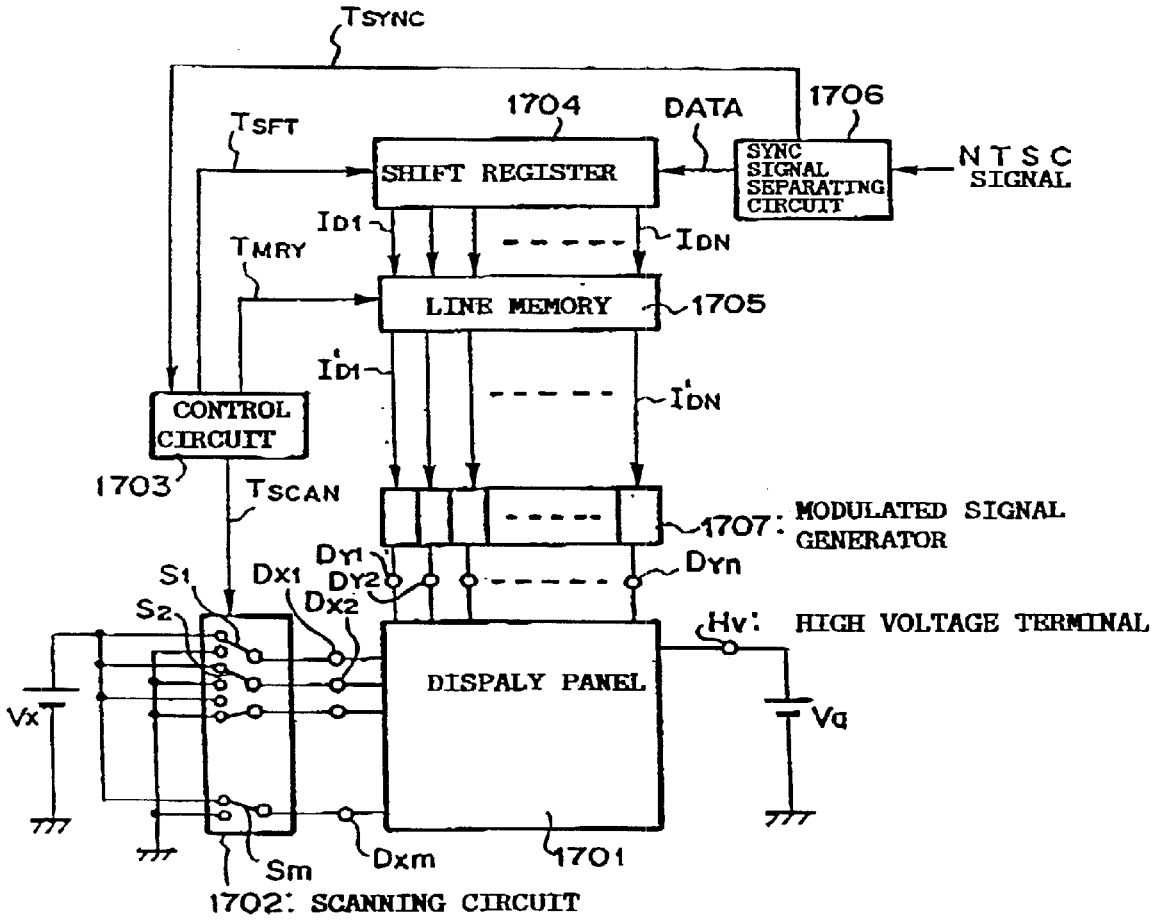

FIG. 25 is a block diagram showing the rough structure of a drive circuit in an image display device in accordance with an embodiment of the present invention.

Figure 26:
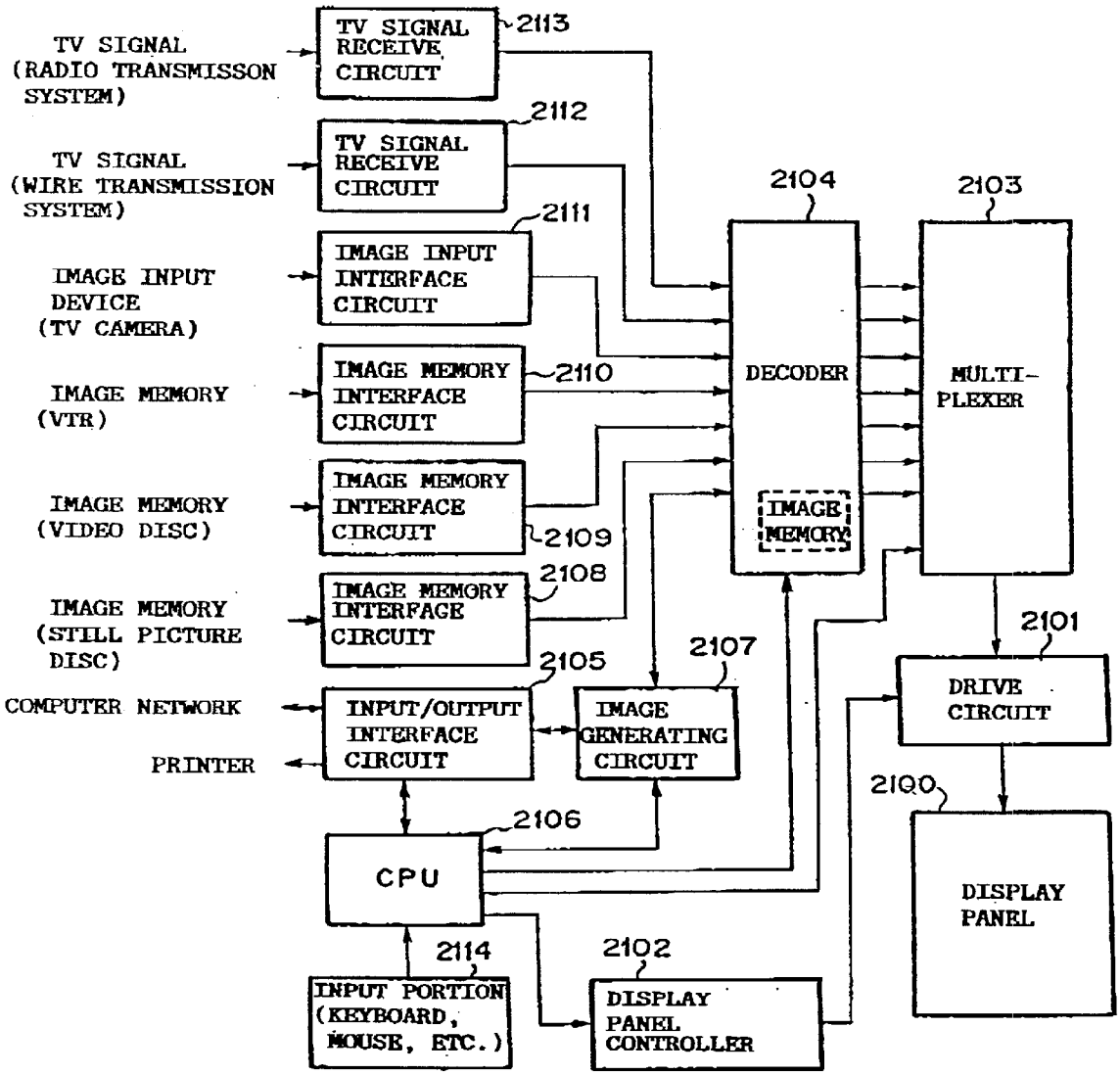

FIG. 26 is a block diagram showing a multi-function image display device using the image display device in accordance with an embodiment of the present invention.

Figure 27:
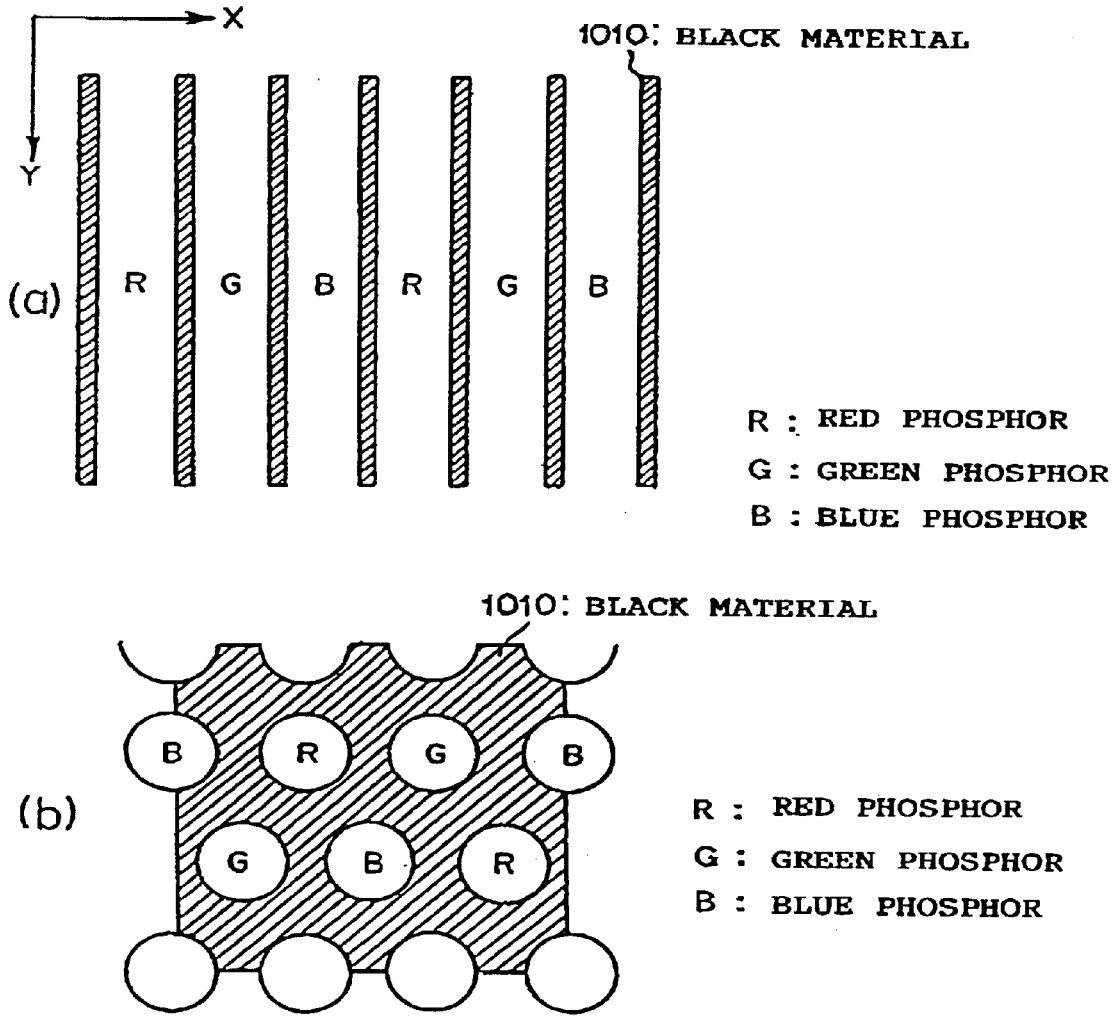

(*a*) and (*b*) of FIG. 27 are plan views exemplifying the arrangement of phosphors on a face plate of a display panel.

Figure 28:
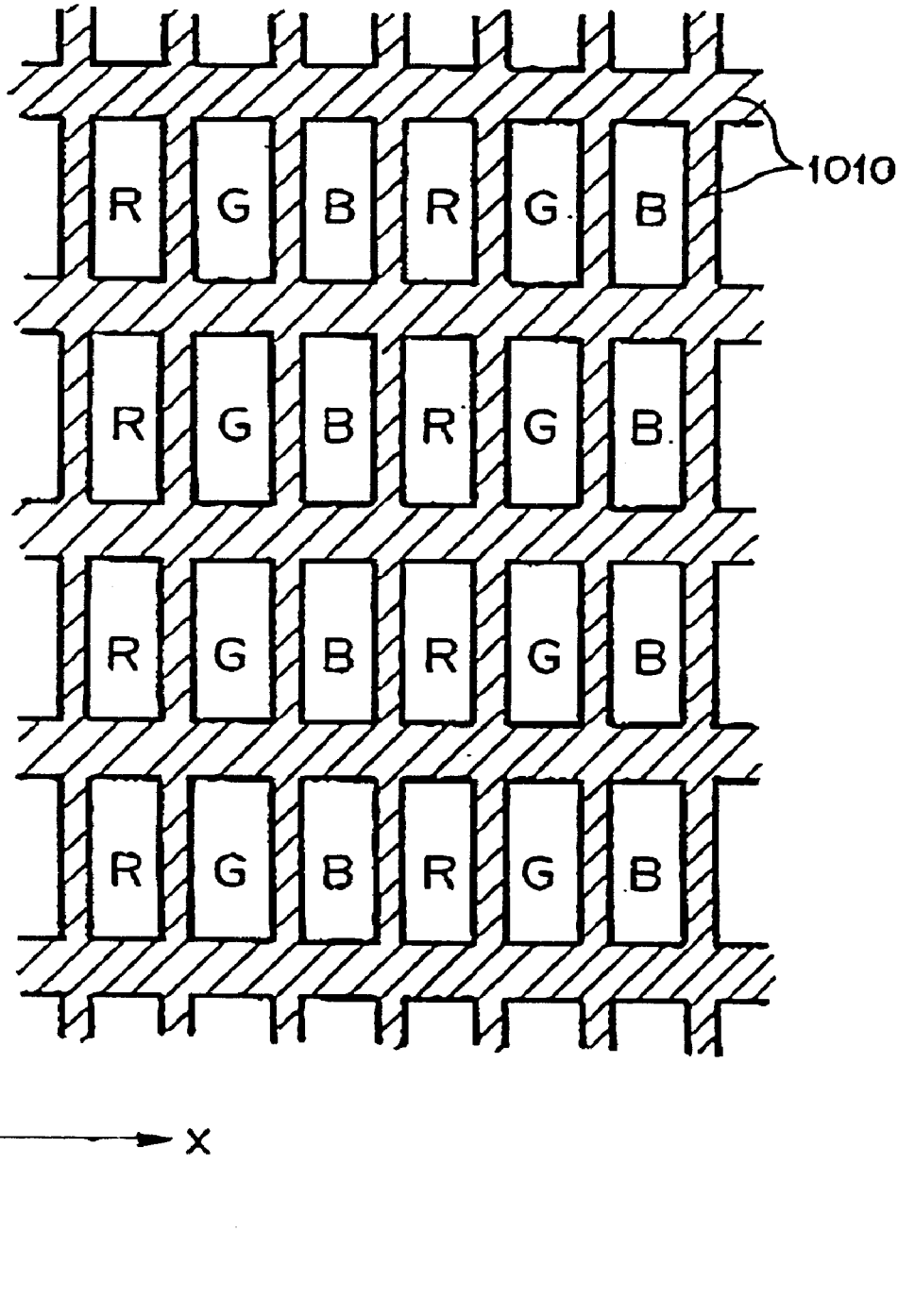

FIG. 28 is a plan view exemplifying another arrangement of phosphors on a face plate of a display panel.

Figure 29:
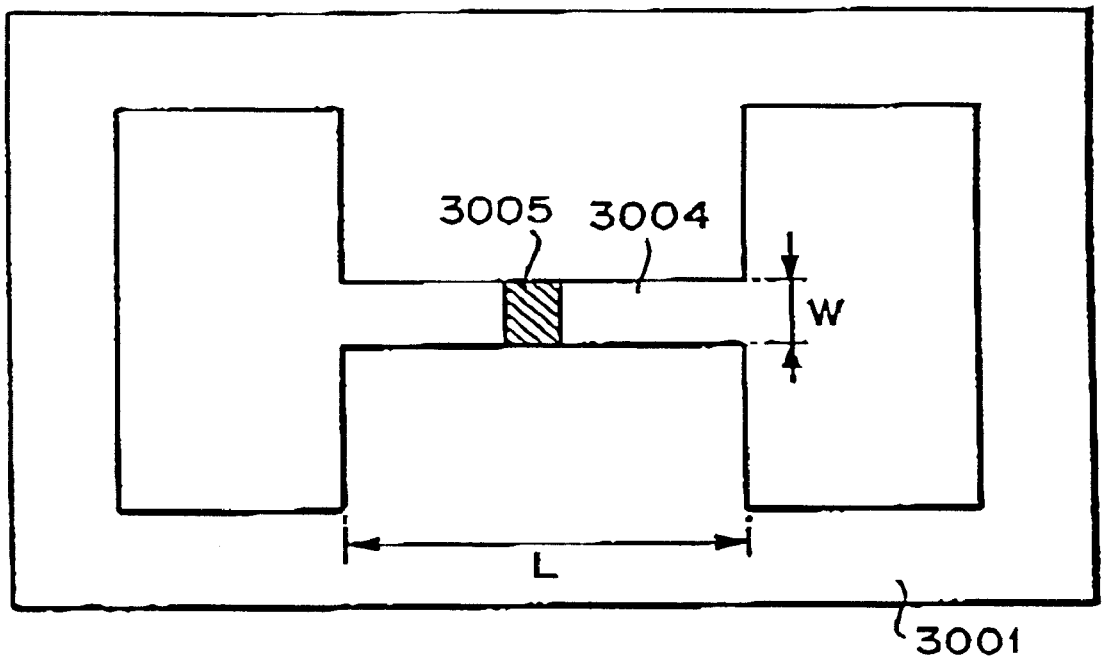

FIG. 29 is a diagram showing an example of a surface conduction type emission element in accordance with a conventional example.

Figure 30:
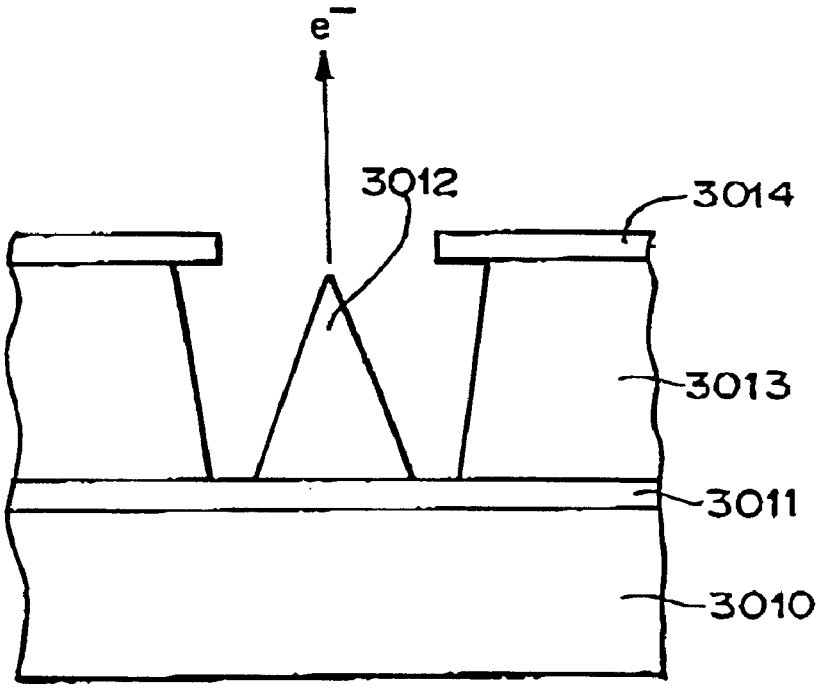

FIG. 30 is a diagram showing an example of an FE element in accordance with another conventional example.

Figure 31:
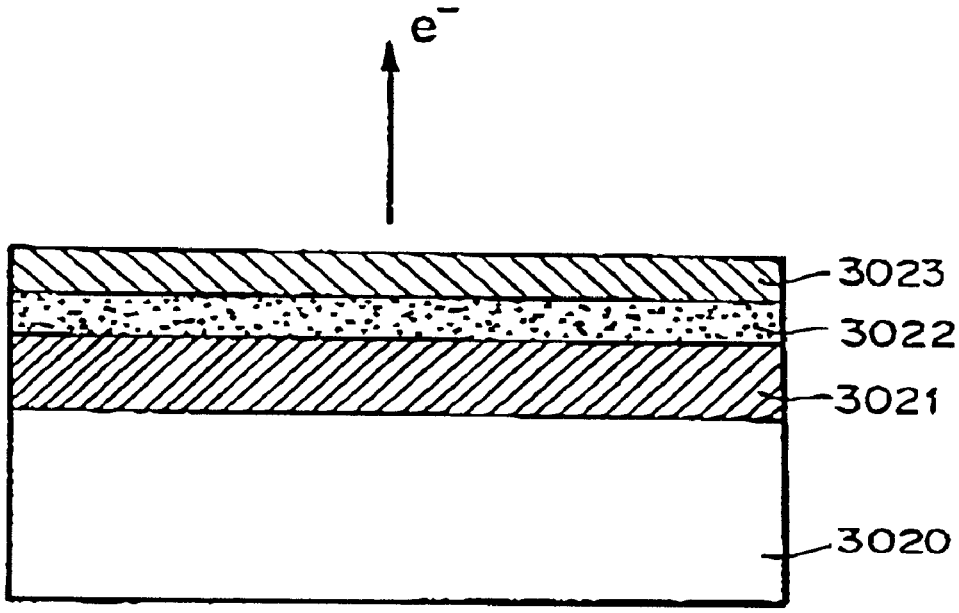

FIG. 31 is a diagram showing an example of an MIM element in accordance with another conventional example.

Figure 32:
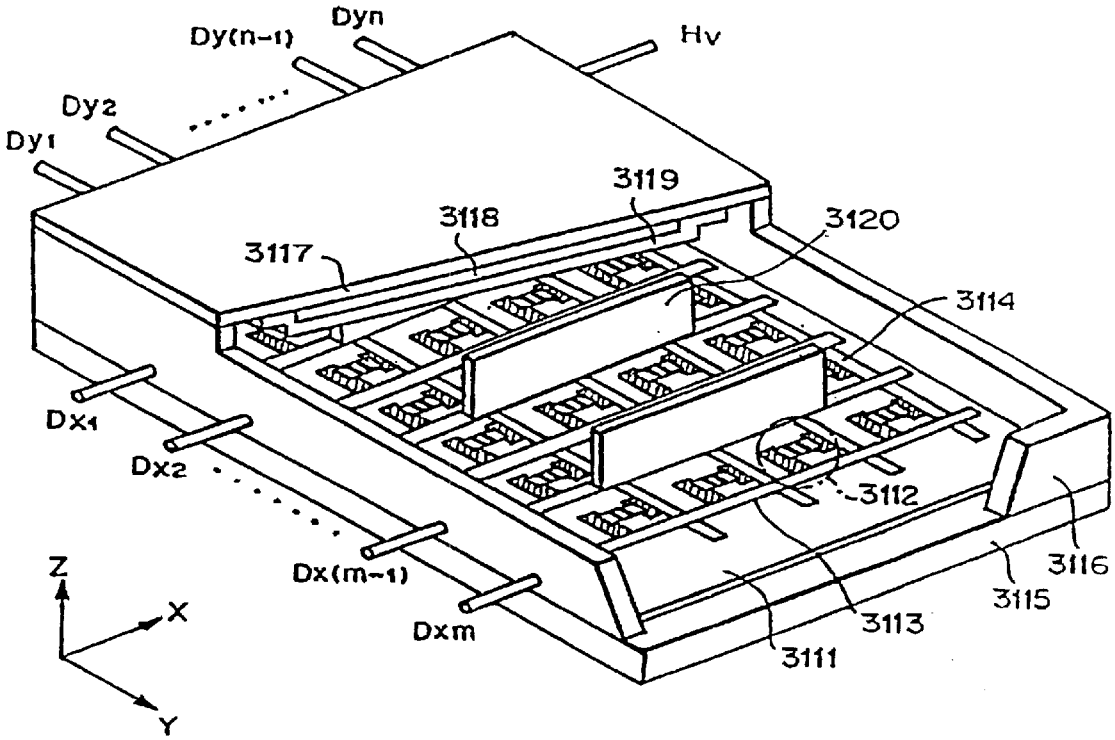

FIG. 32 is a perspective view showing a display panel of an image display device which is partially cut off in accordance with another conventional example.

BEST MODE OF CARRYING OUT THE INVENTION

Embodiment 1

(1) The Summary of an Image Display Device

Subsequently, a description will be given of the structure and a manufacturing method of a display panel in an image display device to which the present invention is applied.

Figure 15:
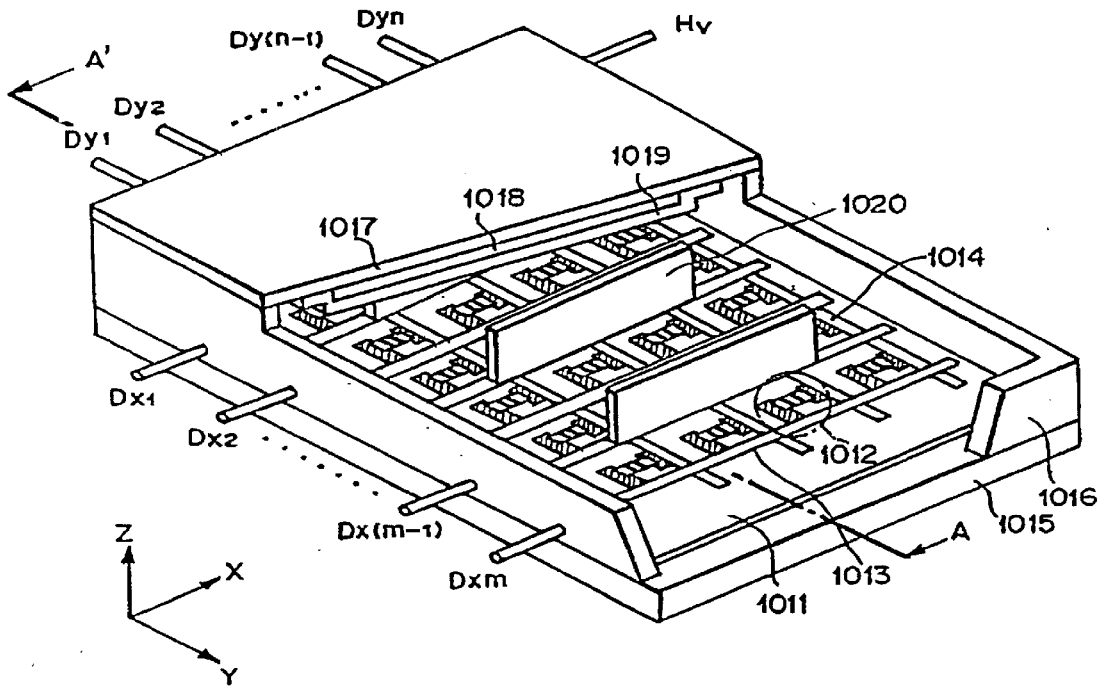
FIG. 15 is a perspective view showing a display panel of an image display device which is partially cut off in accordance with an embodiment of the present invention.

FIG. 15 is a perspective view showing a display panel used in this embodiment in which a part of the panel is cut off in order to show the internal structure.

In the figure, reference numeral 1015 denotes a rear plate, 1016 is a side wall, and 1017 is a face plate, in which the members 1015 to 1017 constitute an airtight vessel for maintaining the interior of a display panel in a vacuum state. In assembling the airtight vessel, it is necessary to seal the joint portions of the respective members in order to maintain the sufficient strength and airtightness. For example, the joint portions are coated with flit glass and then baked at 400 to 500° C. in the atmosphere or nitrogen atmosphere for 10 minutes or longer, to thereby achieve the sealing. A method of exhausting the gas in the interior of the airtight vessel into vacuum will be described later. Also, since the interior of the above airtight vessel is maintained in the vacuum state of about $10^{-6}$ [Torr], the spacers 1020 are disposed as an atmospheric pressure resistant structural body for the purpose of preventing the airtight vessel from being destroyed due to the atmospheric pressure, an unintentional impact, etc.

The rear plate 1015 is fixed with the substrate 1011 on which N×M cold cathode elements 1012 are formed. (N and M are positive integers of 2 or more and appropriately set in accordance with the target number of display pixels. For example, in a display device for the purpose of display of a high-quality television, it is desirable to set the numbers of N=3000 and M=1000, or more.) The N×M cold cathode element are wired in a single matrix by M row-directional wirings 1013 and N column-directional wirings 1014. A portion made up of the above-mentioned members 1011 to 1014 is called "multiple electron beam source".

The multiple electron beam source used in the image display device according to the present invention is not limited to the material, the configuration or the manufacturing method of the cold cathode element if the multiple electron beam source is an electron source in which the cold electrode elements are wired in a single matrix. Accordingly, for example, a surface conduction type emission element, or a cold cathode element of the FE type or the MIM type can be employed.

Subsequently, a description will be given of the structure of a multiple electron beam source in which the surface conduction type emission elements (which will be described later) are arranged on the substrate as the cold cathode elements and wired in a single matrix.

Figure 16:
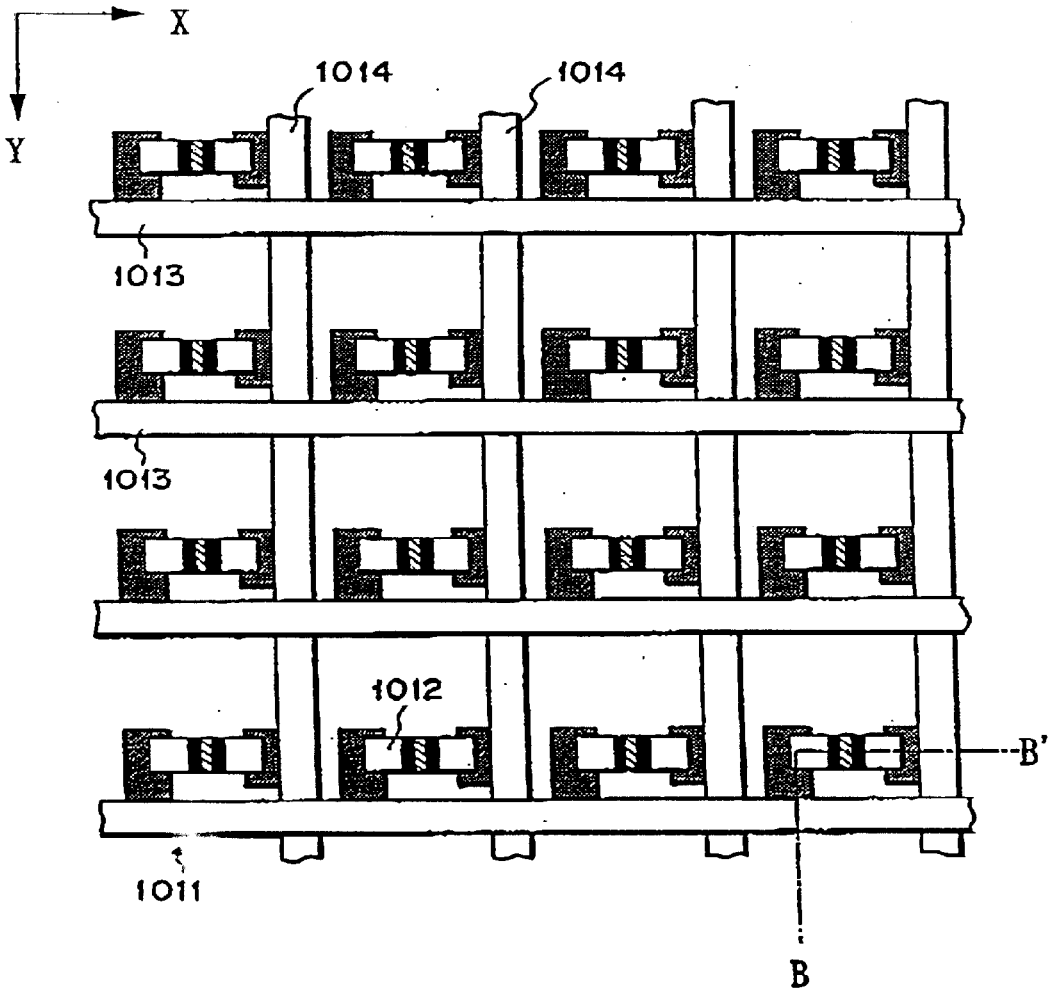
FIG. 16 is a plan view showing a substrate of a multiple electron beam source in accordance with an embodiment of the present invention.

FIG. 16 shows a plan view of the multiple electron beam source used in the display panel shown in FIG. 15. The same surface conduction type emission elements as those shown in FIG. 18 which will be described later are disposed on the substrate 1011, and those elements are wired in a single matrix by the row-directional wirings 1013 and the column-directional wirings 1014. On a portion where the row-directional wirings 1013 and the column-directional wirings 1014 cross each other, insulating layers (not shown) are formed between the electrodes, to thereby maintain electric insulation.

Figure 17:
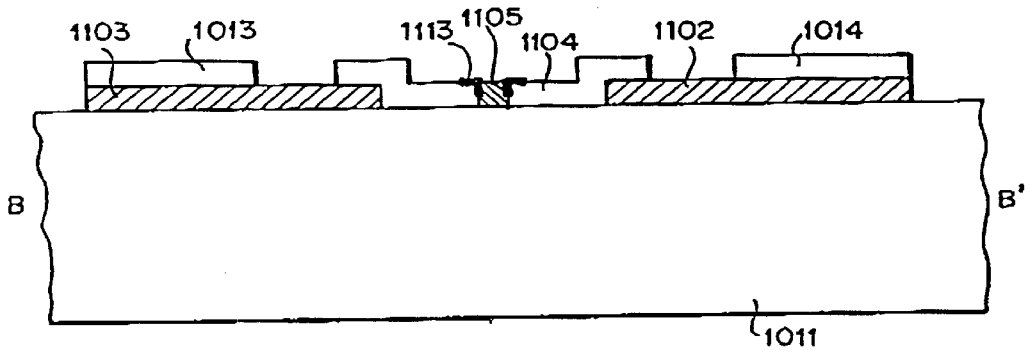
FIG. 17 is a partially cross-sectional view showing the substrate of the multiple electron beam source in accordance with the embodiment of the present invention.

FIG. 17 shows a cross-sectional view taken along a line B–B' of FIG. 16.

The multiple electron source thus structured is manufactured in such a manner where after the row-directional wirings 1013, the column-directional wirings 1014, the interelectrode insulating layer (not shown) and the element electrodes and the electrically conductive thin film of the surface conduction type emission elements have been formed on the substrate in advance, electricity is supplied to the respective elements through the row-directional wirings 1013 and the column-directional wirings 1014 to conduct an electrification forming process (which will be described later) and an electrification activating process (which will be described later).

In this embodiment, the substrate 1011 of the multiple electron beam source is fixed on the rear plate 1015 of the airtight vessel. However, in the case where the substrate 1011 of the multiple electron beam source has a sufficient strength, the substrate 1011 per se of the multiple electron beam source may be used as the rear plate of the airtight vessel.

Also, a fluorescent film 1018 is formed on a lower surface of the face plate 1017. Because this embodiment is directed to a color display device, phosphors of three primary colors consisting of red, green and blue which are used in the field of CRT are painted on a portion of the fluorescent film 1018, separately. The phosphors of the respective colors are distinguishably painted, for example, in stripes as shown in (a) of FIG. 27, and black electric conductors 1010 are disposed between the stripes of the phosphors. The purposes of providing the black electric conductors 1010 are to prevent the shift of the display colors even if a position to which an electric beam is irradiated is slightly displaced, to prevent the deterioration of display contrast by preventing the reflection of an external light, to prevent the charge-up of the fluorescent film due to the electron beams, etc. The black electric conductor 1010 mainly contains black lead, however a material other than black lead may be used if the material is proper for the above purposes.

Also, the manner of distinguishably painting the phosphors of three primary colors is not limited to the arrangement of the stripes shown in (a) of FIG. 27, but, for example, an arrangement in the form of delta shown in (b) of FIG. 27 or other arrangements (for example, FIG. 28) may be applied.

In the case of producing a monochrome display panel, a mono-color phosphor material may be used for the fluorescent film 1018, and the black electric conductor may not necessarily be used.

Also, a metal back 1019 known in the field of CRTs is disposed on a surface of the fluorescent film 1018 on the rear plate side. The purposes of providing the metal back 1019 are to improve the light use ratio by partially mirror-reflecting a light emitted from the fluorescent film 1018, to protect the fluorescent film 1018 from collision of negative ions, to operate the metal back as an electrode for applying the electron beam accelerating voltage, to operate the metal back as as electric conductive path of electrons that excite the fluorescent film 1018, etc. The metal back 1019 is formed in such a manner that after the fluorescent film 1018 has been formed on the face plate substrate 1017, the surface of the fluorescent film is smoothed and Al is vacuum-deposited on the smoothed surface. In the case where the fluorescent film 1018 is made of a phosphor material for a low voltage, the metal back 1019 may not be used.

Also, although being not used in this embodiment, for the purposes of applying the accelerating voltage and improving the electric conductivity of the fluorescent film, for example, a transparent electrode made of ITO may be disposed between the face plate substrate 1017 and the fluorescent film 1018.

Figure 1:
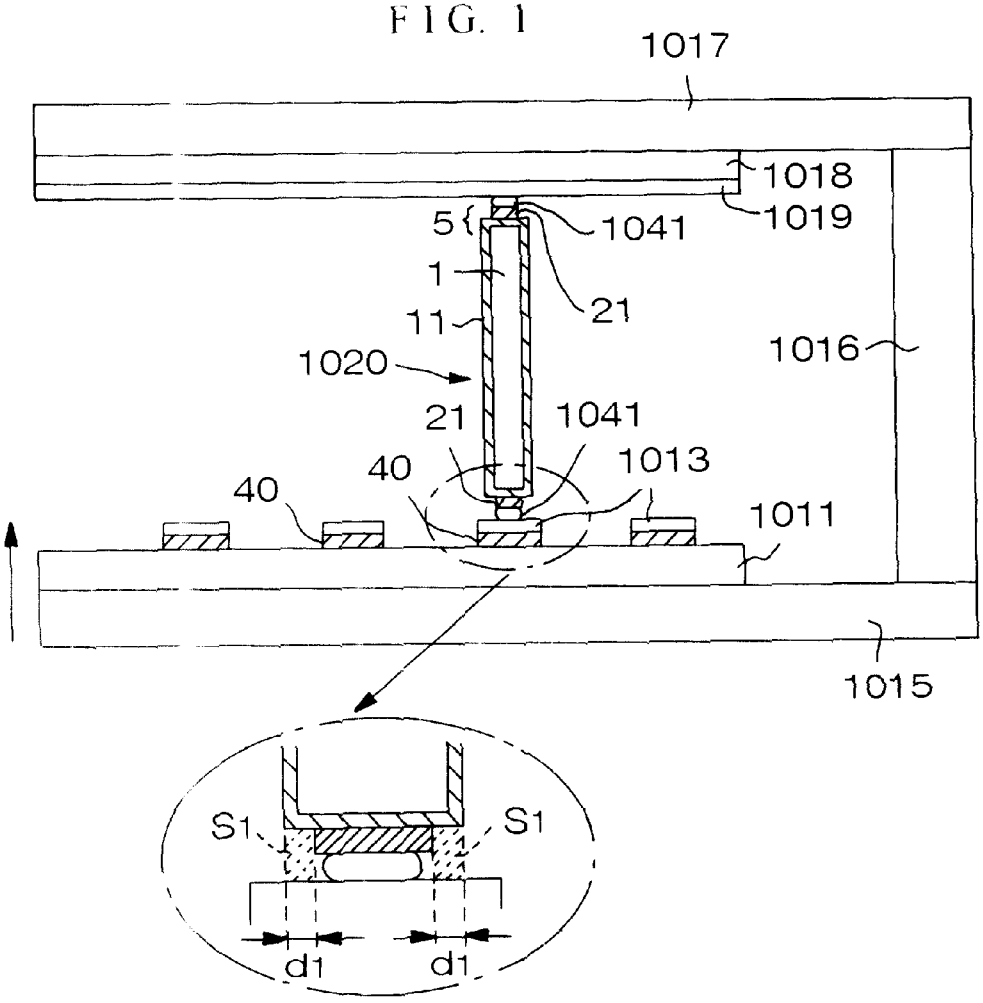
FIG. 1 is a cross-sectional view showing a display panel in accordance with a first embodiment of the present invention.

FIG. 1 is a schematic cross-sectional view taken along a line A—A' of FIG. 15, in which numeral reference of the respective members correspond to those in FIG. 15. The spacer 1020 is coated with a high resistant film 11 for the purpose of preventing the charge on the surface of the insulating member 1. Also, a low resistant film 21 is formed on abutment surfaces which face the inner side of the face plate 1017 (metal back 1019, etc.) and the surface of the substrate 1011 (row-directional wirings 1013 or the column-directional wirings 1014). The spacers 1020 of the number required for achieving the above objects are arranged at required intervals and fixed onto the inner side of the face plate and the surface of the substrate 1011 by a joining material 1041. Also, the high resistant film 11 is formed on at least the surfaces exposed to vacuum within the airtight vessel among the surface of the insulating member 1, and electrically connected to the inside of the face plate 1017 (metal back 1019, etc.) and the surface of the substrate 1011 (the row-directional wirings 1013 or the column-directional wirings 1014) through the low resistant film 21 and the joining material 1041 on the spacer 1020. In the embodiment mode described now, the spacers 1020 are shaped in a thin plate, disposed in parallel with the row-directional wirings 1013, and electrically connected to the row-directional wirings 1013.

It is necessary that the spacer 1020 has the insulation sufficient to withstand a high voltage applied between the row-directional wirings 1013 and the column-directional wirings 1014 on the substrate 1011 and the metal back 1019 on the inner surface of the face plate 1017, and also has the electric conductivity so that the charge on the surface of the spacer 1020 is prevented.

The insulating material 1 of the spacers 1020 may be made of, for example, quartz glass, glass reducing impurity content such as Na, soda lime glass, or a ceramic member such as alumina. It is preferable that the coefficient of thermal expansion of the insulating member 1 is close to that of the members of the airtight vessel and the substrate 1011.

A current obtained by dividing an accelerating voltage Va applied to the face plate 1017 (metal back, etc.) on the high potential side by the resistance Rs of the high resistant film 11 which is an antistatic film flows in the high resistant film 11 which structures the spacer 1020. Therefore, the resistance Rs of the spacer is set to a desired range on the basis of the electric charge and the power consumption. From the antistatic viewpoint, the sheet resistivity is preferably set to $10^{14}$ [Ω/square] or less, more preferably, $10^{12}$[Ω/square] or less. In order to obtain a sufficient antistatic effect, it is most preferable that the sheet resistance is set to $10^{11}$[Ω/square] or less. It is preferable that the lower limit of the sheet resistivity is set to $10^5$ Ω/square or more although it depends on the configuration of the spacer and a voltage applied between the spacers. Further, it is preferable that the lower limit of the sheet resistivity is set to $10^7$ Ω/square or more.

Although the high resistant film 11 depends on the surface energy of the material, the adhesion with the substrate and the substrate temperature, the thin film 10 nm or less in thickness is generally formed in islands, which is unstable in resistance and short in reproductibility. On the other hand, if the thickness t is 1 μm or more, the film stress becomes large with the results that the risk of peeling-of becomes high and the film forming period of time becomes long, thus deteriorating the productivity. Accordingly, it is desirable that the thickness t of the high resistant film 11 formed on the insulating material is set to a range of from 10 nm to 1 μm. The film thickness is more preferably set to 50 to 500 nm. The sheet resistance is ρ/t, and the specific resistance ρ of the high resistant film is preferably set to 0.1 [Ωcm] to $10^8$ [Ωcm] from the above-described preferred ranges of R/square and t. Further, in order to realize the more preferable ranges of the sheet resistance and the film thickness, it is preferable to set ρ to $10^2$ to $10^6$ Ωcm.

The temperature of the spacer rises because a current flows in the high resistant film 11 formed on the surface of the spacer as described above, or the entire display generates heat during its operation. When the resistant temperature coefficient of the high resistant film 11 is a large negative value, when the temperature rises, the resistance is reduced, the current flowing in the spacer increases, and the temperature further rises. Then, the current continues to increase until passing the limit of a power supply. The resistance coefficient value when the above-mentioned run-away of the current occurs is experimentally a negative value and 1% or more in absolute value. That is, it is desirable that the resistant temperature coefficient of the high resistant film 11 is a value larger than −1%.

The material of the high resistant film 11 having the antistatic characteristic may be made of, for example, metal oxide. Among the metal oxide, oxide of chromium, nickel and copper are preferable material. It is presumed that the reason is because those oxides are relatively low in the secondary electron emission coefficient and difficult to be charged even in the case where the electrons emitted from the cold cathode element 1012 hit the spacers 1020. In addition to the metal oxide, carbon is a preferable material because the secondary electron emission coefficient is small. In particular, because amorphous carbon is high in resistance, the spacer resistance is liable to be controlled to a desired value.

As other materials of the high resistant film 11 having the antistatic characteristic, the nitride of aluminum and a transition metal alloy are preferable materials since the resistance can be controlled in a wide range of from excellent electric conductor to insulator. In addition, they are stable materials since a change in resistance is small in a display device manufacturing process which will be described later. Those materials are more than −1% in the resistant temperature coefficient and liable to be used in practical use. As the transition metal element, there are Ti, Cr, Ta and so on.

The alloy nitride film is formed on the insulating member by a thin-film forming means such as sputtering, reaction sputtering in a nitrogen gas atmosphere, electron beam vapor evaporation, ion plating, ion assist vapor evaporation, etc. The metal oxide film can be also manufactured through the same thin-film forming method. However, in this case, nitrogen gas is replaced by oxygen gas and used. Al, the metal oxide film can be formed even through the CVD method or the alkoxide coating method. The carbon film is manufactured through the vapor evaporation method, the sputtering method, the CVD method or the plasma CVD method, and in particular in the case where amorphous carbon is produced, hydrogen is contained in the atmosphere in the film or hydrocarbon gas is used for the film forming gas.

The low resistant film 21 which is an electrode that forms the spacer 1020 is so disposed as to electrically connect the high resistant film 11 to the face plate 1017 at the high potential side (metal back 1019, etc.) and the substrate 1011 (wirings 1013, 1014, etc.) at the low potential side. Hereinafter, the low resistant film 21 is also called "intermediate electrode layer (intermediate layer)". The intermediate electrode layer (intermediate layer) can provide a plurality of functions stated below.

The potential distribution of the high resistant film 11 is uniformed.

The electrons emitted from the cold cathode elements 1012 forms electron orbit in accordance with the potential distribution formed between the face plate 1017 and the substrate 1011. In order to prevent the electron orbit from being disordered in the vicinity of the spacers 1020, it is necessary to control the potential distribution of the high resistant film 11 over the entire regions. In the case where the high resistant film 11 is connected to the face plate 1017 (metal back 1019, etc.) and the substrate 1011 (wirings 1013 and 1014, etc.) directly or through the abutment member 1041, there is the possibility that the unevenness of the connecting state occurs because of the contact resistance on the interface of the connecting portion, and the potential distribution of the high resistant film 11 is shifted from a desired value. In order to prevent this drawback, the low resistant intermediate layer are disposed along the space end portions (the abutment surface 3) where the spacers 1020 abut against the face plate 1017 and the substrate 1011, preferably over the overall length region of the space end portions, and a desired potential is applied to the intermediate layer portion, thereby being capable of controlling the potential of the entire high resistant film 11. With the provision of the low resistant film along the end portion, the unevenness of the entire high resistant film 11 can be controlled. It is unnecessary that the low resistant film comes in direct contact with the electrode against which the spacer is abutted. As will be described later, it is possible that a high resistant film is disposed on the low resistant film, and the low resistant film and the electrode on a surface side against which the spacer is abutted are electrically connected through the high resistant film therebetween.

The high resistant film 11 is electrically connected to the face plate 107 and the substrate 1011.

As we already described above, the high resistant film 11 is provided for the purpose of preventing the electric charge on the surface of the spacer 1020. In the case where the high resistant film 11 is connected to the face plate 1017 (metal back 1019, etc.) and the substrate 1011 (wirings 1013 and 1014, etc.) directly or through the abutment member 1041, a large contact resistor occurs on the interface of the connecting portion with the result that there is the possibility that the electric charges occurring on the surface of the spacer 1020 cannot be rapidly removed. In order to remove this drawback, the low resistant intermediate layer is disposed on the abutment surfaces 3 (partially deleted) of the spacers 1020 which are in contact with the face plate 1017, the substrate 1011 and the abutment member 1041.

The low resistant film 21 may be selected from materials having a resistance sufficiently lower than the high resistant film 11, and is appropriately selected from metal such as Ni, Cr, Au, Mo, W, Pt, Ti, Al, Cu or Pd, or alloy of those metal, metal such as Pd, Ag, Au, $RuO_2$, Pd—Ag, metal oxide, a printing conductor made of glass or the like, transparent conductor such as $In_2O_3$—$SnO_2$, and semiconductor material such as polysilicon.

It is necessary that the joining material 1041 provides electric conductivity so that the spacers 1020 are electrically connected to the row-directional wirings 1013 which are electrodes of the abutment surfaces against which the spacers are abutted and the metal back 1019. That is, flit glass to which an electrically conductive adhesive, metal grains and electrically conductive filler are added is preferable.

Figure 2:
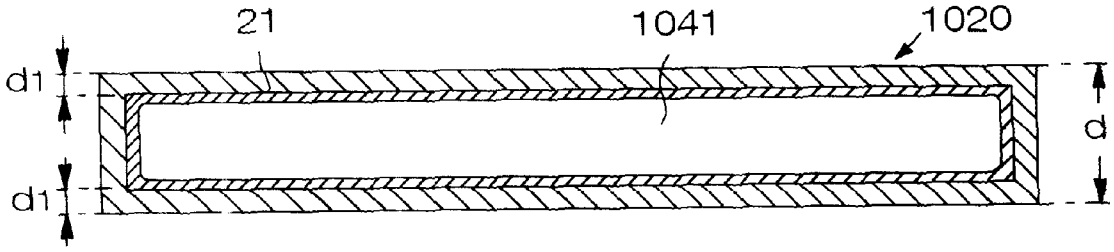
FIG. 2 is a diagram showing a positional relationship of a spacer when being viewed from a substrate side in accordance with the first embodiment of the present invention.

FIG. 2 is a diagram showing a positional relationship of the spacer 1020, the low resistant film 21 and the joining material 1041 when being viewed from the substrate 1011 face (from a direction indicated by an arrow in FIG. 1) in accordance with this embodiment of the present invention.

As is apparent from FIGS. 1 and 2, the low resistant film 21 and the joining materials 1041 are disposed in a region inside a region (hereinafter referred to also as an abutting surface region of the spacer 1020) of a surface of a spacer end portion which is directed to the electron source substrate side or the face plate side. That is, the low resistant film 21 and the joining material 1041 are not disposed in a space S1 between an end portion of the abutting surface region of the spacer 1020 and the abutted surface of the spacer, and a region of the spacer where the low resistant film 21 and the joining material 1041 are disposed is so structured as to be completely included in the abutting surface region of the spacer 1020. In this example, the surface of the spacer end portion which is directed to the electron source substrate side or the face plate side constitutes an end surface of the spacer. It is preferable that the end surface is in parallel with a surface against which the spacer is abutted (in this example, the electron source substrate surface and/or the face plate surface). However, in the case where there is provided, on the spacer end portion, a non-parallel surface (also including a surface with a curvature) directed from a spacer side surface which is a surface that mainly faces the atmosphere between the electron source and the face plate toward a point or a surface which is in contact with or is closest to the electron source substrate and/or the face plate, the surface which is not in parallel with the side surface also constitutes the surface of the spacer end portion which is directed toward the electron source side or the face plate side.

In this example, in the abutting surface region of the spacer 1020, a width d1 of the region where the low resistant film 21 and the joining material 1041 can not disposed, which is measured from the end portion of the abutting surface region is preferably set to 1% or more of a width d of the abutting surface region measured in a direction of the width d1. More preferably, the width d1 is set to 5% or more. Also, since the effect of the low resistant film is reduced if the width d1 is too large, d1 is set to 45% or less of d, preferably 40% or less, more preferably 30% or less.

In this embodiment, the structure is made in such a manner that the joining material 1041 is not also disposed in the space S1 between the end portion of the abutting surface region of the spacer 1020 and the abutted surface of the spacer. However, this condition does not always need to be satisified. This is because the possibility that the joining material 1041 induces discharge is lower whereas the low resistant film 21 disposed on the spacer is liable to occur the discharge because the low resistant film 21 is closer to the accelerating electrode than the joining material 1041.

With this structure, the concentration of the electric field to both of the low resistant film 21 and the joining material 1041 which are liable to form the discharge source is relaxed, to thereby increase the withstand discharge voltage.

In this embodiment, the interface (anode side) of the face plate 1017 and the spacer 1020 is structured in the same manner as the interface (cathode side) of the substrate 1011 and the spacer 1020. However, it is found that a state of the interface (anode side) between the face plate 1017 and the spacer 1020 is not as sensitive to the withstand discharge voltage than the interface (cathode side) between the substrate 1011 and the spacer 1020, and the above structure is not always required, and various structures can be applied.

For example, with the provision of the low resistant intermediate layer even on a side surface portion 5 of a surface against which the face plate 1017 and the spacer 1020 are abutted, the potential distribution in the vicinity of the spacer 1020 has a desired characteristic, thereby being capable of controlling the orbit of the emitted electrons.

This is effective in the following cases.

The electrons emitted from the cold cathode elements 1012 forms electron orbit in accordance with the potential distribution formed between the face plate 1017 and the substrate 1011. There may be a case in which the electrons emitted from the cold cathode elements in the vicinity of the spacer is restricted with the location of the spacer (a change in wiring and the element position, etc.). In this case, in order to form an image without distortion or unevenness, it is necessary to irradiate the electrons onto a desired position on the face plate 1017 by controlling the orbit of the emitted electrons.

The control of the orbit of the emitted electrons due to the intermediate layer can be regarded as one of the above-described functions of the intermediate layers.

Also, Dx1 to Dxm, Dy1 to Dyn and Hv are electric connection terminals with an airtight structure provided for electrically connecting the display panel to an airtight circuit not shown.

Dx1 to Dxm are electrically connected to the row-directional wirings 1013 of the multiple electron beam source, Dy1 to Dyn are electrically connected to the column-directional wirings 1014 of the multiple electron beam source, and Hv is electrically connected to the metal back 1019 of the face plate.

Also, in order to exhaust the interior of the airtight vessel into a vacuum, after the airtight vessel has been assembled, it is connected to an exhaust tube and a vacuum pump not shown, and the interior of the airtight vessel is exhausted to the degree of vacuum of about $10^{-7}$ [Torr]. Thereafter, the exhaust tube is sealed, and in order to maintain the degree of vacuum within the airtight vessel, a getter film (not shown) is formed at a given position within the airtight vessel immediately before sealing or after sealing. The getter film is formed by heating and depositing a getter material that mainly contains, for example, Ba by a heater or a high-frequency heating, and the interior of the airtight vessel is maintained to the degree of vacuum of $1\times10^{-5}$ to $1\times10^{-7}$ [Torr] due to the adsorption action of the getter film.

In the image display device using the above-described display panel, when a voltage is applied to the respective cold cathode element 1012 through the vessel external terminals Dx1 to Dxm and Dy1 to Dyn, electrons are emitted from the respective cold cathode elements 1012. At the same time, when a high voltage of several hundreds [V] to several [kV] is applied to the metal back 1019 through the vessel external terminal Hv, the emitted electrons are accelerated and made to collide with the inner surface of the face plate 1017. As a result, the phosphors of the respective colors which form the fluorescent film 1018 are excited to emit a light, thereby displaying an image.

Usually, a supply voltage to the surface conduction type electron-emitting devices 1012 which are the cold cathode elements according to the present invention is about 12 to 16 [V], a distance d between the metal back 1019 and the cold cathode elements 1012 is about 0.1 [mm] to 8 [mm], a voltage between the metal back 1019 and the cold cathode elements 1012 is about 0.1 [kV] to 10 [Kv].

The above description is given of the outline of the image display device in accordance with the embodiment of the present invention.

(2) A Method of Manufacturing the Multiple Electron Beam Source

Subsequently, a description will be given of a method of manufacturing the multiple electron beam source used in the display panel of the above embodiment. The multiple electron beam source used in the image display device of this embodiment is not limited to the material, the configuration or the manufacturing method of the cold cathode element if the multiple electron beam source is an electron source in which the cold electrode elements are wired in a single matrix. Accordingly, for example, a surface conduction type emission element, or a cold cathode element of the FE type or the MIM type can be employed.

However, under the circumstances where the image display device large in a display screen and the image display device that is inexpensive is demanded, the surface conduction type electron-emitting device is particularly preferable among those cold cathode elements. That is, in the FE type, because the relative position and the configuration of the emitter cone and the gate electrode largely influence the electron emission characteristic, the manufacturing technique with an extremely high precision is required. However, this becomes a disadvantageous factor in order to achieve the large area and the reduction of the manufacture costs. Also, in the MIM type, it is necessary to thin the thicknesses of the insulating layer and the upper electrode and also unify the thickness. However, this also leads to a disadvantageous factor in order to achieve the large area and the reduction of the manufacture costs. From this viewpoint, in the surface conduction type electron-emitting device, because the manufacturing method is relatively simple, it is easy to achieve the large area and the reduction of the manufacture costs. Also, the present inventors have found that among the surface conduction type electron-emitting devices, the electron-emitting device in which the electron emission portion or its peripheral portion is formed of a fine grain film is particularly excellent in the electron emission characteristic and is readily manufactured. Accordingly, such an element is most preferable when being used in the multiple electron beam source in the image display device high in luminance and large in screen. Therefore, in the display panel of the above-mentioned embodiment, there is used the surface conduction type electron-emitting device in which the electron emission portion or its peripheral portion is formed of a fine grain film. First, a description will be given of a basic structure, the manufacturing method and the characteristic in the preferable surface conduction type electron-emitting device, and thereafter a description will be given of the structure of the multiple electron beam source in which a large number of elements are wired in a simple matrix.

[Preferable Element Structure and Manufacturing Method of Surface Conduction Type Electron-Emitting Device]

The representative structure of the surface conduction type electron-emitting device in which the electron emission portion or its peripheral portion is formed of a fine grain film are classified into two kinds consisting of the plane type and the vertical type.

(Plane Type Surface Conduction Type Emission Element)

First of all, a description will be given of the element structure and the manufacturing method of the plane type surface conduction type electron-emitting device. (*a*) and (*b*) of FIG. 18 are a plan view and a cross-sectional view for explanation of the structure of the plane type surface conduction type electron-emitting device. In the figures, reference numeral 1011 denotes a substrate, 1102 and 1103 are element electrodes, 1104 is an electrically conductive thin film, 1105 is an electron emission portion formed through an electrification forming process, and 1113 is a thin film formed through an electrification activating process.

The substrate 1011 may be formed of, for example, various glass substrates such as quartz glass or blue plate glass, various ceramic substrates such as alumina, the above-mentioned various substrates on which an insulating layer with material of, for example, $SiO_2$ is stacked, etc.

Also, the element electrodes 1102 and 1103 which are disposed on the substrate 1011 and face each other in parallel with the substrate surface are made of electrically conductive material. For example, the material is appropriately selected from the material consisting of, for example, metal such as Ni, Cr, Au, Mo, W, Pt, Ti, Cu, Pd or Ag, or alloy of those metal, metal oxide such as $In_2O_3$—$SnO_2$, or semiconductor material such as polysilicon. The formation of the element electrodes can be readily achieved by using the combination of, for example, the film forming technique such as vacuum evaporation with the patterning technique such as photolithography or etching. However, those electrodes may be formed by using other methods (for example, printing technique).

The configuration of the element electrodes 1102 and 1103 can be appropriately designed in accordance with the applied purpose of the electron-emitting device. In general, the electrode interval L is designed by selecting an appropriate numerical value usually from a range of from several hundreds [Å] to several hundred μm. Among them, the range preferred for applying the electron-emitting device to the display device is several μm to several tens μm. Also, the thickness d of the element electrode is usually selected from an appropriate numerical value of a range of from several hundred [Å] to several μm.

Also, the fine grain film is used on a portion of the electrically conductive thin film 1104. The fine grain film described here means a film containing a large number of fine grains as the structural element (also containing the assembly of islands). When investigating the fine grain film microscopically, there are usually observed a structure in which the respective fine grains are isolated from each other, a structure in which the respective fine grains are adjacent to each other, or a structure in which the respective fine grains are overlapped with each other.

The diameter of the fine grains used in the fine grain film is in a range of from several [Å] to several thousand [Å], and more preferably in a range of from 10 [Å] to 200 [Å]. Also, the thickness of the fine grain film is appropriately set taking the various conditions stated below into consideration. That is, a condition required for electrically satisfactorily connecting the fine grain film to the element electrodes 1102 or 1103, a condition required for satisfactorily conducting the electrification forming which will be described later, a condition required for setting the electric resistance of the fine grain film per se to an appropriate value which will be described later, etc. Specifically, the electric resistance is selected in a range of from several [Å] to several thousand [Å], and most preferably in a range of from 10 [Å] to 500 [Å].

Also, the material used for forming the fine grain film may be, for example, metal such as Pd, Pt, Ru, Ag, Au, Ti, In, Cu, Cr, Fe, Zn, Sn, Ta, W, or Pd, oxide such as PdO, $SnO_2$, $In_2O_3$, PbO, or $Sb_2O_3$, boride such as $HfB_2$, $ZrB_2$, $LaB_6$, $CeB_6$, $YB_4$ or $GdB_4$, carbide such as TiC, ZrC, HfC, TaC, SiC or WC, nitride such as TiN, ZrN or HfN, semiconductor such as Si or Ge, and carbon, from which an appropriate material is selected.

As described above, the electrically conductive thin film 1104 is formed of the fine grain film, and its sheet resistance is set in a range of $10^3$ to $10^7$ [Ω/square].

Because it is desirable that the electrically conductive thin film 1104 and the element electrodes 1102, 1103 are electrically satisfactorily connected to each other, portions of the respective members are superimposed on each other. The superimposing manner is that in the example of FIG. 18, where the substrate, the element electrodes, and the electrically conductive thin film are stacked on each other in the stated order from the bottom, but depending on the occasion, the substrate, the electrically conductive thin film and the element electrodes may be stacked on each other in the stated order from the bottom.

Also, the electron emission portion 1105 is a crack portion formed on a portion of the electrically conductive thin film 1104 and electrically has a higher resistant property than the electrically conductive thin film. The crack is formed by conducting the electrification forming process which will be described later with respect to the electrically conductive thin film 1104. There is a case in which the fine grains several [Å] to several hundreds [Å] in grain diameter are disposed within the crack. Because it is difficult to show the position and the configuration of the actual electron emission portion with precision and accuracy in the figure, it is schematically shown in FIG. 18.

Also, the thin film 1113 is a thin film made of carbon or carbon compound and coats the electron emission portion 1105 and its vicinity. The thin film 1113 is formed by conducting the electrification activating process which will be described later, after the electrification forming process.

The thin film 1113 is made of any one of mono-crystal graphite, poly-crystal graphite and amorphous carbon, or the mixture thereof, and the thickness is set to 500 [Å] or less, and more preferably set to 300 [Å] or less. Because it is difficult to show the position and the configuration of the actual thin film 1113 with precision in the figure, it is schematically shown in FIG. 18.

The above description is given of the basic structure of the preferred element, and an element as described below is used in the embodiment.

That is, the substrate 1101 is made of blue plate glass, and the element electrodes 1102 and 1103 are formed of Ni thin films. The thickness d of the element electrodes is 1000 [Å], and the electrode interval L is 2 [μm].

As the main material of the fine grain film, Pd or PdO is used and the thickness of the fine grain film is about 100 [Å] and the width W is 100 [μm].

Subsequently, a description will be given of a method of manufacturing the preferred plane type surface conduction type electron-emitting device. (*a*) to (*d*) of FIG. 19 are cross-sectional views for explanation of a process of manufacturing the surface conduction type electron-emitting device, and the references of the respective members are identical with those in FIG. 18.

1) First, as shown in (*a*) of FIG. 19 the element electrode 1102 and 1103 are formed on the substrate 1011.

In the formation of the element electrode 1102 and 1103, the substrate 1011 has been sufficiently cleaned by using a detergent, pure water and organic solvent in advance, and the material of the element electrodes are deposited. As a depositing method, for example, a vacuum film forming technique such as the evaporation method or the sputtering method may be used. Thereafter, the deposited electrode material is patterned by using the photolithography and etching technique to form a pair of element electrodes (1102 and 1103) shown in (*a*) of FIG. 19.

2) Then, as shown in (*b*) of FIG. 19, the electrically conductive thin film 1104 is formed.

In formation of the electrically conductive thin film 1104, after an organic metal solvent is coated on the substrate shown in the above (*a*) of FIG. 19, it is dried. After a heat baking process is conducted to form the fine grain film, the film is patterned in a given configuration by the photolithography etching. In this example, the organic metal solvent is directed to a solution of the organic metal compound which contains as the main element the material of the fine grains used for the electrically conductive thin film. (Specifically, the main elements in this embodiment is Pd.

Also, in this embodiment, as a coating method, the dipping method is used, however other methods such as a spinner method or a spray method may also be used.)

Also, as a method of forming the electrically conductive thin film formed of the fine grain film, there is a case of using other than the organic metal solution coating method used in this embodiment, for example, a vapor evaporation method, a sputtering method, or a chemical gas phase depositing method,.

3) Then, as shown in (*c*) of FIG. 19, an appropriate voltage is applied between the element electrodes 1102 and 1103 from the forming power supply 1110 to conduct the electrification forming processing, thus forming the electron emission portion 1105.

The electrification forming process means a process in which electrification is conducted on the electrically conductive thin film 1104 formed of the fine grain film to appropriately destroy, deform or affect a part of the electrically conductive film 1104 into a structure suitable for conducting electron emission. In a portion which is changed into the preferred structure for conducting the electron emission among the electrically conductive thin film formed of the fine grain film (that is, the electron emission portion 1105), an appropriate crack is formed in the thin film. As compared with the electron emission portion 1105 before formation, the electric resistance measured between the element electrodes 1102 and 1103 greatly increases after the electron emission portion 1105 has been formed.

In order to describe the electrifying method in more detail, FIG. 20 shows an example of an appropriate voltage waveform which is applied from the forming power supply 1110. In the case where the electrically conductive thin film formed of the fine grain film is formed, a pulse voltage is preferable, and in the case of this embodiment, as shown in the figure, chopping pulses each having a pulse width T1 is continuously applied at a pulse interval T2. In this situation, a peak value Vpf of the chopping pulse sequentially steps up. Also, a monitor pulse Pm for monitoring the forming state of the electron emission portion 1105 is inserted between the chopping pulses at an appropriate interval, and a current that flows in this state is measured by an ammeter 1111.

In this embodiment, under the vacuum atmosphere of, for example, about $10^{-5}$ [Torr], for example, the pulse width T1 is 1 [msec], the pulse interval T2 is 10 [msec], and the peak value Vpf steps up 0.1 [V] every 1 pulse. Then, one monitor pulse Pm is inserted between the chopping pulses every time 5 chopping pulses are applied. The voltage Vpm of the monitor pulse is set to 0.1 [V] so that the forming process is not adversely affected. Then, at a state where the electric resistance between the element electrodes 1102 and 1103 becomes $1\times10^{6}$ [Ω], that is, at a stage where the current measured by the ammeter 1111 when the monitor pulse is applied becomes $1\times10^{-7}$ [A], electrification for the forming process is completed.

The above method is a preferable method pertaining to the surface conduction type electron-emitting device according to this embodiment, for example, in the case where the design of the surface conduction type electron-emitting device such as the material and the thickness of the fine grain film, the element electrode interval L, etc., are changed, it is desirable to change the conditions of the electrification in accordance with the change of design.

4) Then, as shown in (*d*) of FIG. 19, an appropriate voltage is applied between the element electrodes 1102 and 1103 by using the activation power supply 1112 to conduct the electrification activating process, thus improving the electron emission characteristic.

The electrification activating process is directed to a process in which the electron emission portion 1105 formed through the above electrification forming process is electrified under an appropriate condition to deposit carbon or carbon compound in the vicinity of the electron emission portion 1105 (in the figure, an accumulation made of carbon or carbon compound is schematically shown as the member 1113). Further, the emission current at the same supply voltage can increase typically 100 times or more through the electrification activating process as compared with a case in which the electrification activating process is not yet conducted.

Specifically, the voltage pulses are periodically applied under the vacuum atmosphere within a range of $10^{-4}$ to $10^{-5}$ [Torr] to deposit carbon or carbon compound derived from the organic compound existing in the vacuum atmosphere. The accumulation 1113 is made of any of mono-crystal graphite, poly-crystal graphite, and amorphous carbon, or the mixture thereof, and the thickness is set to 500 [Å] or less, and more preferably set to 300 [Å] or less.

In order to describe the electrifying method in more detail, (*a*) of FIG. 21 shows an example of the appropriate voltage waveform which is applied from the activation power supply 1112. In this embodiment, a rectangular wave of a constant voltage is periodically applied to conduct the electrification activating process. Specifically, the voltage Vac of the rectangular wave is set to 14 [V], the pulse width T3 is set to 1 [msec], and the pulse interval T4 is set to 10 [msec]. The above-described electrifying conditions are preferable conditions pertaining to the surface conduction type electron-emitting device according to this embodiment, and in the case where the design of the surface conduction type electron-emitting device is changed, it is desirable to appropriately change the conditions in accordance with the change of the design.

Reference numeral 1114 shown in (*d*) of FIG. 19 is an anode electrode for catching the emission current Ie emitted from the surface conduction type emission element, and a d.c. high voltage power supply 1115 and the current ammeter 1116 are connected (in the case where the substrate 1011 is assembled into the display panel to conduct the activating process, the fluorescent surface of the display panel is used as the anode electrode 1114). The emission current Ie is measured by the ammeter 1116 while a voltage is applied from the activation power supply 1112, and the progress state of the electrification activating process is monitored, to control the operation of the activation power supply 1112. An example of the emission current Ie measured by the ammeter 1116 is shown in FIG. 21(*b*). When a pulse voltage starts to be applied from the activation power supply 1112, the emission current Ie increases with time but thereafter is saturated so as not to substantially increase. In this way, at a time point where the emission current Ie is substantially saturated, the voltage supply from the activation power supply 1112 stops to complete the electrification activating process.

The above-described electrifying conditions are preferable conditions pertaining to the surface conduction type emission element according to this embodiment, and in the case where the design of the surface conduction type emission element is changed, it is desirable to appropriately change the conditions in accordance with the change of the design.

In the above-mentioned manner, the plane type surface conduction type electron-emitting device as shown in (*e*) of FIG. 19 is manufactured.

[Vertical Type Surface Conduction Type Emission Element]

Subsequently, another representative structure of the surface conduction type emission element in which the electron emission portion or its peripheral portion is formed of the fine grain film, that is, the structure of the vertical type surface conduction type emission element, will be described.

FIG. 22 is a schematic cross-sectional view for explaining the basic structure of the vertical type, and in the figure, reference numeral 1011 denotes a substrate, 1202 and 1203 are element electrodes, 1206 is a step forming member, 1204 is an electrically conductive thin film formed of the fine grain film, 1205 is an electron emission portion formed through the electrification forming process, and 1213 is a thin film formed through the electrification activating process.

Differences of the vertical type from the plane type described in the above reside in that one of the element electrodes (1202) is disposed on the step forming member 1206, and the electrically conductive thin film 1204 is coated on the side surface of the step forming member 1206. Accordingly, the element electrode interval L in the plane type shown in the above FIG. 18 is set as a step height Ls of the step forming member 1206 in the vertical type. In the substrate 1011, the element electrodes 1202, 1203, and the electrically conductive thin film 1204 formed of the fine grain film, the same materials as those described in the above plane type can be similarly used. Also, the step forming member 1206 is made of an electrically insulating material, for example, such as $SiO_2$.

Subsequently, a method of manufacturing the vertical type surface conduction type emission element will be described. (*a*) to (*f*) of FIG. 23 are cross-sectional views for explaining of the manufacturing process, and the references of the respective members are identical with those in FIG. 22.

1) First, as shown in (*a*) of FIG. 23, the element electrode 1203 is formed on the substrate 1011.
2) Subsequently, as shown in (*b*) of FIG. 23, an insulating layer for forming the step forming member is stacked. The insulating layer may be formed by stacking, for example, $SiO_2$ through the sputtering method, however other film forming methods such a vapor evaporation method or a printing method may be used.
3) Then, as shown in (*c*) of FIG. 23, the element electrode 1202 is formed on the insulating layer.
4) Then, as shown in of FIG. 23, a part of the insulating layer is removed by using, for example the etching method to expose the element electrode 1203.
5) Then, as shown in (*e*) of FIG. 23, the electrically conductive thin film 1204 formed using the fine grain film is formed. In the formation, a film forming technique, for example such as a coating method may be used similarly as in the above plane type.
6) Then, the electrification forming process is conducted to form the electron emission portion as in the above plane type (the same process as that of the plane type electrification forming process described with reference to (*c*) of FIG. 19 may be conducted.)
7) Then, the electrification activating process is conducted to deposit carbon or carbon compound in the vicinity of the electron emission portion as in the case of the above plane type (the same process as that of the plane type electrification activating process described with reference to (*d*) of FIG. 19 may be conducted.)

In the above-mentioned manner, the vertical type surface conduction type emission element shown in (*f*) of FIG. 23 is manufactured.

[Characteristic of Surface Conduction Type Emission Element used in Display Device]

The above description is given of the element structures and the manufacturing methods of the plane type and vertical type surface conduction type emission element. Subsequently, the characteristic of the element used in the display device will be described.

FIG. 24 shown a typical example of the emission current Ie to element supply voltage Vf characteristic, and the element current If to the element supply voltage Vf characteristic in the element used in the display device. Further, since the emission current Ie is remarkably small as compared with the element current If, it is difficult to shown the emission current Ie by the same unit, and those characteristics change by changing the design parameters such as the size or configuration of the element. Therefore, those two graphs are exhibited by arbitrary units, respectively.

The element used in the display device has the following three characteristics related to the emission current Ie.

First, when a voltage of a given voltage or more (called "threshold voltage Vth) is applied to the element, the emission current Ie rapidly increases. On the other hand, when the voltage is lower than the threshold voltage Vth, the emission current Ie is hardly detected.

In other words, it is a non-linear element having a definite threshold voltage Vth with respect to the emission current Ie.

Secondly, because the emission current Ie changes depending on the voltage Vf applied to the element, the amplitude of the emission current Ie can be controlled by the voltage Vf.

Thirdly, because a response speed of the current Ie emitted from the element with respect to the voltage Vf applied to the element is fast, the amount of charges of electrons emitted from the element can be controlled by the length of a period of time during which the voltage Vf is applied.

Because the above-mentioned characteristics are provided, the surface conduction type emission element can be preferably used in the display device. For example, in the display device in which a large number of elements are disposed in correspondence with the pixels of the display screen, the display screen can be sequentially scanned and displayed by using the first characteristic. In other words, a voltage of the threshold voltage Vth or higher is appropriately applied to the driving element in response to the desired light emitting luminance, and a voltage lower than the threshold voltage Vth is applied to a non-selected state element. When the driving element is sequentially changed over, the display screen can be sequentially scanned and displayed.

Also, because the light emitting luminance can be controlled by using the second characteristic or the third characteristic, the graduation display can be displayed.

(Structure of Multiple Electron Beam Source in which a Large Number of Elements are Wired in a Single Matrix)

Subsequently, a description will be given of the structure of a multiple electron beam source in which the above-mentioned surface conduction type emission elements are disposed on the substrate and wired in a single matrix.

FIG. 16 is a plan view of the multiple electron beam source used in the display panel shown in FIG. 15. The same surface conduction emission elements as those shown in FIG. 18 are arranged on the substrate, and those elements are wired in a single matrix by the row-directional wiring electrodes 1003 and the column-directional wiring electrodes 1004. On a portion where the row-directional wiring electrode 1003 and the column-directional wiring electrode 1004 cross each other, insulating layers (not shown) are formed between the electrodes, to thereby maintain electric insulation.

FIG. 17 shown a cross-section taken along a line B–B' of FIG. 16.

The multiple electron source thus structured is manufactured in such a manner where after the row-directional wiring electrode 1013, the column-directional wiring electrode 1014, the interelectrode insulating layer (not shown) and the element electrodes and the electrically conductive thin film of the surface conduction type emission elements have been formed on the substrate in advance, electricity is supplied to the respective elements through the row-directional wiring electrode 1013 and the column-directional wiring electrode 1014 to conduct an electrification forming process and an electrification activating process.

(3) Drive Circuit Structure (and Driving Method)

FIG. 25 is a block diagram showing the rough structure of a drive circuit for a television display on the basis of a television signal of the NTSC system. In the figure, a display panel 1701 corresponds to the above-described display panel, which is manufactured and operates as described above. Also, a scanning circuit 1702 scans the display line, and a control circuit 1703 produces a signal, etc. to be inputted to scanning circuit. A shift register 1704 shifts data for one line, and a line memory 1705 inputs data for one line from the shift register 1704 to a modulated signal generator 1707. A synchronous signal separating circuit 1706 separates a synchronous signal from the NTSC signal.

Hereinafter, the functions of the respective portions in the device shown in FIG. 25 will be described in detail.

First, the display panel 1701 is connected to an external electric circuit through terminals Dx1 to Dxm, Dy1 to Dyn and a high voltage terminal Hv. To the terminals Dx1 to Dxm is applied a scanning signal for sequentially driving the multiple beam source disposed within the display panel 1701, that is, the cold cathode elements which are wired in a matrix of m rows×n columns for each row (n pixels). On the other hand, to the terminals Dy1 to Dyn is applied a modulated signal for controlling the output electron beams of the respective n elements for one row which is selected by the above scanning signal. Also, to the high voltage terminal Hv is supplied a d.c. voltage of, for example, 5 [kV] from the d.c. voltage source Va. This is an accelerating voltage for giving sufficient energy for exciting the phosphors to the electron beam outputted from the multiple electron beam source.

Then, the scanning circuit 1702 will be described. The circuit includes m switching elements (in the figure, schematically represented by S1 to Sm) therein, and the respective switching elements select any one of the output voltage of the d.c. voltage source Vx and 0 [V] (ground level) and are electrically connected to the terminals Dx1 to Dxm of the display panel 1701. The respective switching elements of S1 to Sm operate on the basis of a control signal Tscan outputted from the control circuit 1703, and in fact, can be readily structured by the combination of the switching elements such as FETs. The above d.c. voltage source Vx is so set as to output a constant voltage so that the drive voltage applied to the element not scanned becomes the electron emission threshold voltage Vth or lower on the basis of the characteristic of the electron-emitting device exemplified in FIG. 24.

The control circuit 1703 matches the operation of the respective portions so that appropriate display is conducted on the basis of an image signal inputted from the external. The respective control signals of Tscan, Tsft, and Tmry are produced to the respective portions, on the basis of the synchronous signal Tsync transmitted from the synchronous signal separating circuit 1706 which will be described next. The synchronous signal separating circuit 1706 is a circuit for separating a synchronous signal component and a luminance signal component from a television signal of the NTSC system which is inputted from the external. The synchronous signal separated by the synchronous signal separating circuit 1706 consists of a vertical synchronous signal and a horizontal synchronous signal as is well known, but is shown as a Tsync signal for convenience of description. On the other hand, the luminance signal component of the image separated from the above television signal is represented by a DATA signal for convenience, and the signal is inputted to the shift register 1704.

The shift register 1704 is so designed as to serial-parallel convert the above DATA signal inputted in a serial in a time series for one line of the image, and operates on the basis of the control signal Tsft transmitted from the above control circuit 1703. In other words, the control signal Tsft can be also called the shift clock of the shift register 1704. The data for one line of the image which is serial/parallel converted (corresponding to the drive data for n elements of the electron-emitting device) is outputted from the shift register 1704 as n signals of Idl to Idn.

The line memory 1705 is a memory device for storing data for one line of the image for a required period of time, and appropriately stores the contents of Idl to Idn in accordance with the control signal Tmry transmitted from the control circuit 1703. The stored contents are outputted as I'dl to I'dn and then inputted to the modulated signal generator 1707.

The modulated signal generator 1707 is a signal source for appropriately driving and modulating the respective electron-emitting devices 1015 in correspondence with the above respective image data I'dl to I'dn, and its output signal is supplied to the electron-emitting device 1015 within the display panel 1701 through the terminals Dy1 to Dyn.

As was described with reference to FIG. 24, the surface conduction type emission element according to the present invention has the following basic characteristics with respect to the emission current Ie. That is, the electron emission provides the definite threshold voltage Vth (8 [V] in the surface conduction type emission element according to an embodiment which will be described later), and the electrons are emitted only at a time when a voltage of the threshold voltage Vth or higher is applied. Also, the emission current Ie also changes with respect to the voltage of the electron emission threshold value Vth or higher in correspondence with a change in voltage as shown in the graph of FIG. 24. From this fact, in the case where a pulse voltage is applied to the element, for example even if a voltage of the electron emission threshold value Vth or lower is applied to the element, the electrons are not emitted. On the other hand, in the case where a voltage of the electron emission threshold value Vth or higher is applied to the element, the electron beam is outputted from the surface conduction type emission element. In this situation, it is possible to control the intensity of the output electron beam by changing the peak value Vm of the pulse. Also, it is possible to control the total amount of the charges of the outputted electron beam by changing the width Pw of the pulse.

Accordingly, as a system of modulating the electron-emitting device in response to an input signal, a voltage modulating system, a pulse width modulating system, etc., are applicable. In carrying out the voltage modulating system, as the modulated signal generator 1707, there can be used a circuit of the voltage modulating system which generates a voltage pulse of a constant length, and appropriately modulates the peak value of the pulse in accordance with the inputted data. Also, in implementing the pulse width modulating system, as the modulated signal generator 1707, there can be used a circuit of the pulse width modulating system which generates a voltage pulse of a constant peak value and appropriately modulates the width of the voltage pulse in accordance with the inputted data.

The shift register 1704 and the line memory 1705 may be of the digital signal type or the analog signal type. Namely, this is because the serial to parallel conversion of the image signal and the storage may be conducted at a given speed.

In the case of using the digital signal system, it is necessary to convert the output signal DATA of the synchronous signal separating circuit 1706 into a digital signal. To satisfy this, an A/D convertor may be disposed on an output portion of the synchronous signal separating circuit 1706. In association with this, the circuit used in the modulated signal generator is slightly different depending on whether an output signal of the line memory 115 is a digital signal or an analog signal. In other words, in a case of the voltage modulating system using the digital signal, for example, a D/A converting circuit is used for the modulated signal generator 1707, and as necessary, an amplifying circuit is added. In a case of the pulse width modulating system, in the modulated signal generator 1707, a circuit that combines a high-speed oscillator, a counter that counts the number of waves outputted from the oscillator, and a comparator that compares an output value of the counter with an output value of the memory is used. As necessary, there can be added an amplifier for voltage-amplifying the modulated signal which is modulated in pulse width and outputted from the comparator up to the drive voltage of the electron-emitting device.

In a case of the voltage modulating system using the analog signal, for example, an amplifying circuit using an operational amplifier can be applied to the modulated signal generator 1707, and as necessary, a shift level circuit, etc., can be added. In a case of the pulse width modulating system, for example, a voltage control type oscillating circuit (VCO) can be applied, and as necessary, an amplifier for amplifying the voltage up to the drive voltage of the electron-emitting device can be added.

In the image display device thus structured to which the present invention can be applied, a voltage is applied to the respective electron-emitting devices through the vessel external terminals Dx1 to Dxm, and Dy1 to Dyn to emit the electrons. A high voltage is applied to the metal back 1019 or the transparent electrode (not shown) through a high voltage terminal Hv to accelerate the electron beam. The accelerated electrons collide with the fluorescent film 1018 and emit a light, to thereby form an image.

The structures of the above image display device is an example of the image forming apparatus to which the present invention is applicable, and various modifications can be conducted on the basis of the concept of the present invention. The input signal is of the NTSC system, but the input signal is not limited to this system. The PAL, SECAM system as well as the TV signal (for example, high grade TV) system using a larger number of scanning lines can be also applied.

FIG. 26 is a diagram showing one example of a multiple function display device structured in such a manner that image information supplied from various image information sources, for example, including television broadcast can be displayed on a display panel using the above-described surface conduction type emission elements as an electronic beam source.

In the figure, reference numeral 2100 denotes a display panel, 2101 is a drive circuit of the display panel, 2102 is a display controller, 2103 is a multiplexer, 2104 is a decoder, 2105 is an input/output interface circuit, 2106 is a CPU, 2107 is an image generating circuit, 2108, 2109 and 2110 are image memory interface circuits, 2111 is an image input interface circuit, 2112 and 2113 are TV signal receiving circuits, and 2114 is an input portion. (The display device according to this embodiment displays video information and at the same time reproduces audio information when the device receives a signal including both of the video information and the audio information, for example, as with a television signal. However, circuits pertaining to the reception, separation, reproduction, processing, storage of the audio information, a speaker and so on which are not directly concerned with the features of the present invention will be omitted from description.)

Hereinafter, the functions of the respective parts will be described along a flow of the image signal.

First, the TV signal receiving circuit 2113 is a circuit for receiving a TV image signal transmitted on a radio transmission system such as electric waves or spatial optic communication. The system of the received TV signal is not particularly limited, and various systems of the NTSC system, the PAL system, the SECAM system and so on may be applied. Also, a TV signal having a larger number of scanning lines than those systems (for example, a so-called high-grade TV such as a MUSE system) is a proper signal source for exhibiting the advantage of the above-described display panel suitable for a large area or a large number of pixels. The TV signal received by the TV signal receiving circuit 2113 is outputted to the decoder 2104.

The TV signal receiving circuit 2112 is a circuit for receiving the TV image signal transmitted on the wire transmitting system such as a coaxial cable or an optical fiber. As in the above TV signal receiving circuit 2113, the system of the received TV signal is not particularly limited. Also, the TV signal received by this circuit is outputted to the decoder 2104.

The image input interface circuit 2111 is a circuit for taking in an image signal supplied from an image input device for example a TV camera or an image reading scanner, and the taken-in image signal is outputted to the decoder 2104.

Also, the image memory interface circuit 2110 is a circuit for taking in an image signal stored in a video tape recorder (hereinafter referred to as VTR), and the taken-in image signal is outputted to the decoder 2104.

Further, the image memory interface circuit 2109 is a circuit for taking in an image signal stored in a video disc, and the taken-in image signal is outputted to the decoder 2104.

Further, the image memory interface circuit 2108 is a circuit for taking in an image signal from a device that stores still image data, a so-called still image disc, and the taken-in still image signal is outputted to the decoder 2104.

The input/output interface circuit 2105 is a circuit for connecting the present display device to an output device such as an external computer, a computer network or a printer. The input/output interface circuit 2105 conducts the input/output of image data, character/graphic information, and also can conduct the input/output of a control signal or numerical data between the CPU 2106 provided in the present display device and the external as occasion demands.

The image generating circuit 2107 is a circuit for generating image data for display on the basis of image data or character/graphic information inputted from the external through the input/output interface circuit 2105 or image data or character/graphic information outputted from the CPU 2106. The interior of the image generating circuit 2107 is equipped with circuits necessary for generating the image, such as a rewritable memory for storing, for example, the image data and the character/graphic information, a read only memory in which an image pattern corresponding to character codes are stored, and a processor for conducting image processing, etc.

The image data for display generated by the image generating circuit 2107 is outputted to the decoder 2104, but can be outputted to the external computer network or the printer through the input/output interface circuit 2105 as occasion demands.

Further, the CPU 2106 mainly conducts the operation control of the present display device, and work pertaining to the generation, selection or edit of the display image.

For example, the control signal is outputted to the multiplexer 2103, and the image signal displayed on the display panel is appropriately selected or combined. In this case, the control signal is generated with respect to the display panel controller 2102 in response to the image signal to be displayed, and the operation of the display device such as a screen display frequency, a scanning method (for example, interlace or non-interlace) or the number of scanning lines for one screen is appropriately controlled.

Also, the image data or the character/graphic information is directly outputted to the image generating circuit 2107, or the external computer or the memory is accessed through the input/output interface circuit 2105 to input the image data or the character/graphic information.

Further, the CPU 2106 may of course pertain to the works for other purposes. For example, the CPU 2106 may be directly concerned with a function of generating or processing the information as in a personal computer, a word processor, etc.

Also, as described above, the CPU 2106 may be connected to the external computer network through the input/output interface circuit 2105, and cooperates works such as numerical calculation with the external device.

Further, the input portion 2114 is so designed as to input a command, program or data to the CPU 2106 by a user. For example, various input devices such as a joy stick, a bar code reader, or a voice recognizing device in addition to a keyboard or a mouse can be used.

Also, the decoder 2104 is a circuit for reversely converting various image signals inputted from the above devices 2107 to 2113 into a three primary color signal, or a luminance signal and an I signal, a Q signal. As indicated by a dotted line in the figure, it is desirable that the decoder 2104 includes an image memory therein. This is to deal with the television signal that requires the image memory in reserve conversion as in, for example, the MUSE system. Further, with the provision of the image memory, the display of the still picture is facilitated. Also, there are advantages in that the image processing and editing such as an image thinning, interpolation, enlargement, reduction or composition are facilitated in cooperation with the image generating circuit 2107 and the CPU 2106.

Also, the multiplexer 2103 is so designed as to appropriately select the display image on the basis of the control signal inputted from the CPU 2106. That is, the multiplexer 2103 selects a desired image signal from the reversely converted image signals inputted from the decoder 2104 to output the selected image signal to the drive circuit 2101. In this case, if the image signal is changed over and selected within a display period of one screen, one screen is divided into a plurality of areas so that different images can be displayed on each area as in a so-called multi-screen television.

Also, the display panel controller 2102 is a circuit for controlling the operation of the drive circuit 2101 on the basis of the control signal inputted from the above CPU 2106.

Further, as the basic operation of the display panel, for example, a signal for controlling the operating sequence of a power supply (not shown) for driving the display panel is outputted to the drive circuit 2101.

Further, as the mentioned of driving the display panel, for example, a signal for controlling the screen display frequency or the scanning method (for example, interlace or non-interlace) is outputted to the drive circuit 2101.

Also, as occasion demands, a control signal pertaining to the adjustment of an image quality such as the luminance, the contrast, the tone or the sharpness of a display image is outputted to the drive circuit 2101.

Further, the drive circuit 2101 is a circuit for generating a drive signal applied to the display panel 2100 and operates on the basis of an image signal inputted from the multiplexer 2103 and a control signal inputted from the display panel controller 2102.

The above description was given of the functions of the respective parts. With the structure illustrated in FIG. 26, the present display device can display the image information inputted from the various image information sources on the display panel 2100.

That is, after various image signals such as the television broadcast has been reversely converted by the decoder 2104, those image signals are appropriately selected in the multiplexer 2103 and then inputted to the drive circuit 2101. On the other hand, the display controller 2102 generates a control signal for controlling the operation of the drive circuit 2101 in response to the image signal to be displayed. The drive circuit 2101 applies a drive signal to the display panel 2100 on the basis of the image signal and the control signal.

With this operation, the image is displayed on the display panel 2100. Those sequential operation is controlled by the CPU 2106 in a generalizing manner.

Also, the present display device is cooperated with an image memory equipped in the decoder 2104, the image generating circuit 2107 and the CPU 2106, to not only display the image selected from a plurality of image information, but also can conduct image processing for example, enlargement, reduction, rotation, movement, edge emphasis, thinning, interpolation, color conversion, or the conversion of the longitudinal to lateral ratio of an image, or image editing such as composition, erasion, connection, replacement or insertion with respect to the image information to be displayed. Also, although being not particularly described in this embodiment, an exclusive circuit for processing or editing the audio information may be provided as in the above image processing or the image edition.

Accordingly, the present display device can provide the functions of display device of the television broadcast, the terminal device for television conference, the image editing device for dealing with the still picture and the moving picture, the terminal device of the computer, a business terminal device such as a word processor, a playing machine, together. Therefore, the present display device is extremely broad in applied field for industrial or public use.

Further, FIG. 26 merely shows a one example of the structure of a display device using a display panel with the surface conduction type emission element as the electron bean source, and it is needless to say that the present invention is not limited to only the above structure. For example, the circuit pertaining to the function unnecessary for the purpose of use may be omitted from the structural elements shown in FIG. 26. Also, conversely, the structural element may be further added depending on the purpose of use. For example, in the case where the present display device is applied as a television phone, it is preferable to add a television camera, an audio microphone, a lighting equipment, a transmit/receive circuit including a modem to the structural elements.

In this display device, since it is easy to thin the display panel with the surface conduction type emission element as the electron beam source, the depth of the entire display device can be reduced. In addition, because the large-area is easy, the luminance is high and the field angle characteristic is also excellent in the display panel using the surface conduction type emission element as the electron beam source, the image high in attendance feeling and powerful can be displayed with a high visibility.

Embodiment 2

Only a difference of an embodiment 2 according to the present invention to the embodiment 1 will be described.

Figure 3:
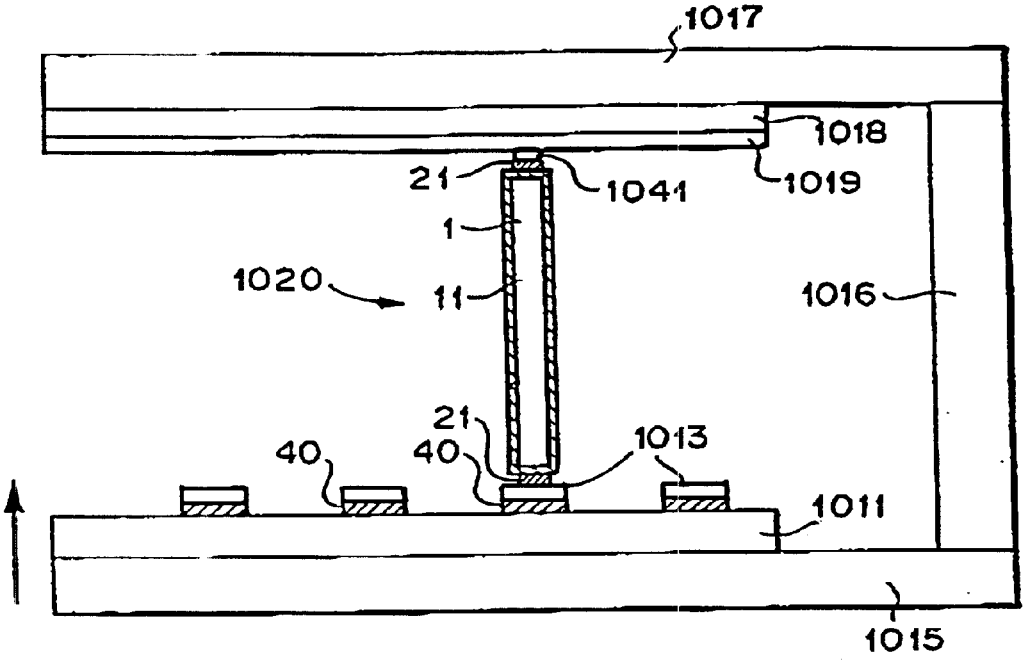
FIG. 3 is a cross-sectional view showing a display panel in accordance with a second embodiment of the present invention.
Figure 4:
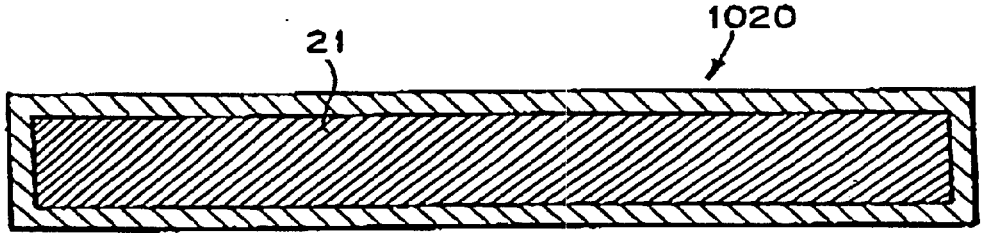
FIG. 4 is a diagram showing a positional relationship of a spacer when being viewed from a substrate side in accordance with the second embodiment of the present invention.

FIGS. 3 and 4, respectively are schematic cross-sectional views showing an image display device in accordance with this embodiment, and a diagram showing a positional relationship of the spacer 1020 and the low resistant film 21 and the joining material 1041 when being viewed from the substrate 1011 face (from a direction indicated by an arrow in FIG. 3) in accordance with this embodiment, which correspond to FIGS. 1 and 2 of the embodiment 1

A difference from the embodiment 1 resides in that the joining material 1041 that fixes the substrate 1011 and the spacer 1020 is not provided. That is, the spacer 1020 is fixed only onto the face plate 1017 by the joining material 1041.

Similarly, in this embodiment, the low resistant film 21 is so structured as to be completely included on the abutting surface of the spacer 1020 on the substrate 1011 side, and the concentration of the electric field to the low resistant film 21 which is liable to form the discharge source is relaxed, to thereby increase the withstand discharge voltage.

According to this structure, not only the electrically conductive joining material 1041 which is one of what is liable to function as the discharge source can be omitted on the cathode side, but also the assembling process can be simplified.

On the contrary, because joining material 1041 which serves as a shock absorber and a filler is not provided, higher precision is required for a gap between the face plate 1017 and the substrate 1011, the smoothness of the wiring surface, and so on.

Further, the structure of the periphery of the spacer is variuosly selected on the basis of the function of the above-described joining material, the feature of the anode side described in the embodiment 1, and so on. Specifically, on the substrate 1011 side and the face plate 1017 side of the spacer 1020, the presence/absence of the low resistant film 21 and the joining material 1041 are selected, respectively.

At least one of the low resistant film 21 and the joining material 1041 is provided on the substrate 1011 side of the spacer 1020 to give the effect of suppressing the unevenness of the potential of the spacer and when only any one is provided, it is so designed to be completely included in the abutting surface region. In the case where both of the low resistant film 21 and the joining material 1041 are provided, at least the low resistant film 21 which is an electrode disposed on the spacer is so designed as to be completely included in the abutting surface region. In the case where only the joining material 1041 is provided, the joining material 1041 functions as an electrode that suppresses the unevenness of the potential of the spacer. Also, taking into consideration that a current is allowed to flow through the spacer, it is preferable that the electric connection of the face plate 1017 side to the electrode of the face plate 1017 (metal back which serves as the anode electrode in this embodiment) by using at least any one of the low resistant film 21 or the joining material 1041.

Embodiment 3

Only a difference of an embodiment 3 according to the present invention from the embodiment 1 will be described.

Figure 5:
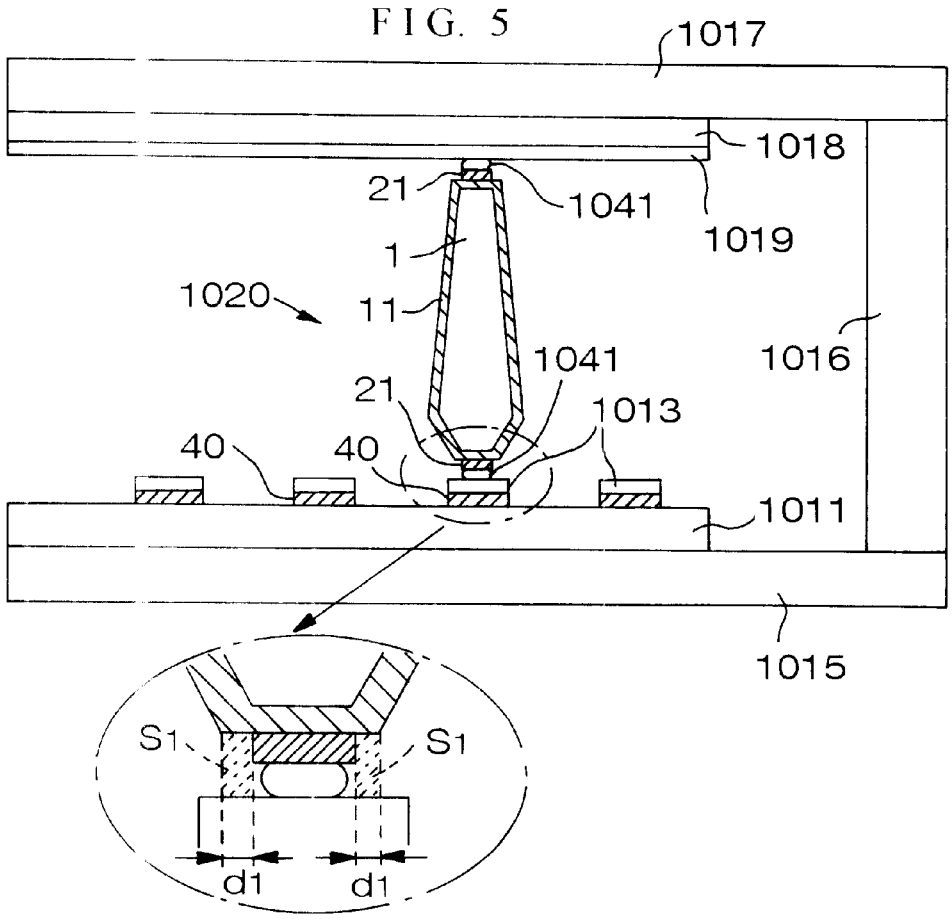
FIG. 5 is a cross-sectional view showing one example of a display panel in accordance with a third embodiment of the present invention.

FIG. 5 is a cross-sectional view showing an image display device in accordance with this embodiment corresponding to FIG. 1 of the embodiment 1

A difference from the embodiment 1 resides in the configuration of the spacer a cross-section which is shaped in a hexagon with a swollen middle portion as shown in FIG. 5.

Similarly, in this embodiment, the low resistant film 21 and the joining material 1041 are so structured as to be completely included in the abutting surface region.

Figure 6:
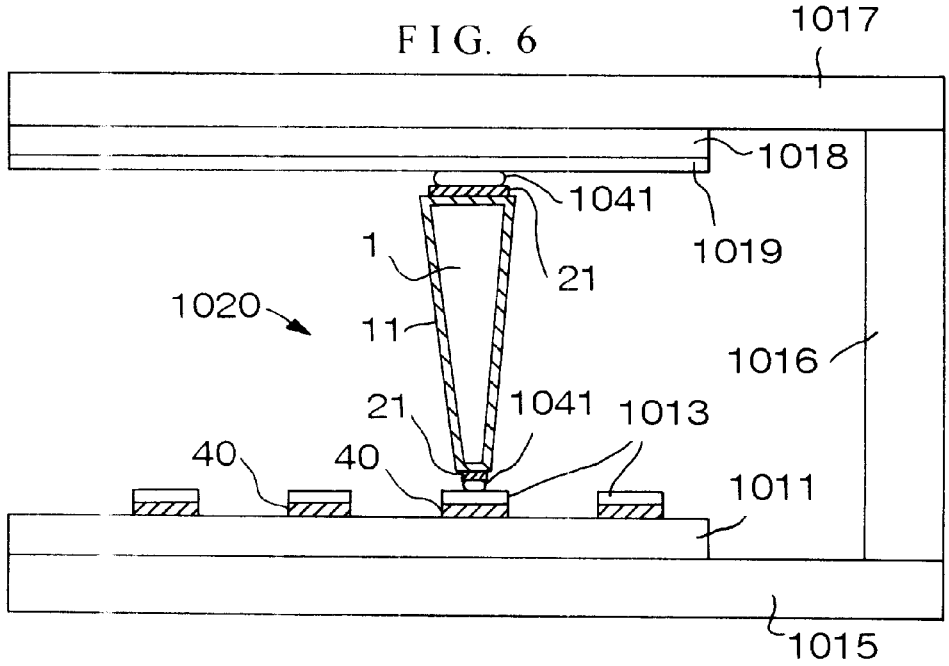
FIG. 6 is a cross-sectional view showing another example of a display panel in accordance with the third embodiment of the present invention.

As described in this embodiment, there are various configurations of the spacer to which the present invention can be applied to. For example, as shown in FIG. 6, a spacer the cross-sectional configuration of which is expanded upward can be used.

In the above-mentioned conditions, the structure of the periphery of the spacer (the respective presence/absence of the low resistant film 21 and the joining material 1041 on both sides of the spacer 1020, and a range where they are formed) may be variously selected as described in the embodiment 2.

Embodiment 4

The above-described embodiments show the examples in which the low resistant film 21 which is an electrode disposed along an end portion of the spacer is formed before the formation of the high resistant film 11 which is an electrically conductive film for suppressing the electric charge of the spacer or an influence of the electric charge of the spacer on the orbit of the electrons, and the low resistant film 21 is formed on the high resistant film 11.

Figure 7:
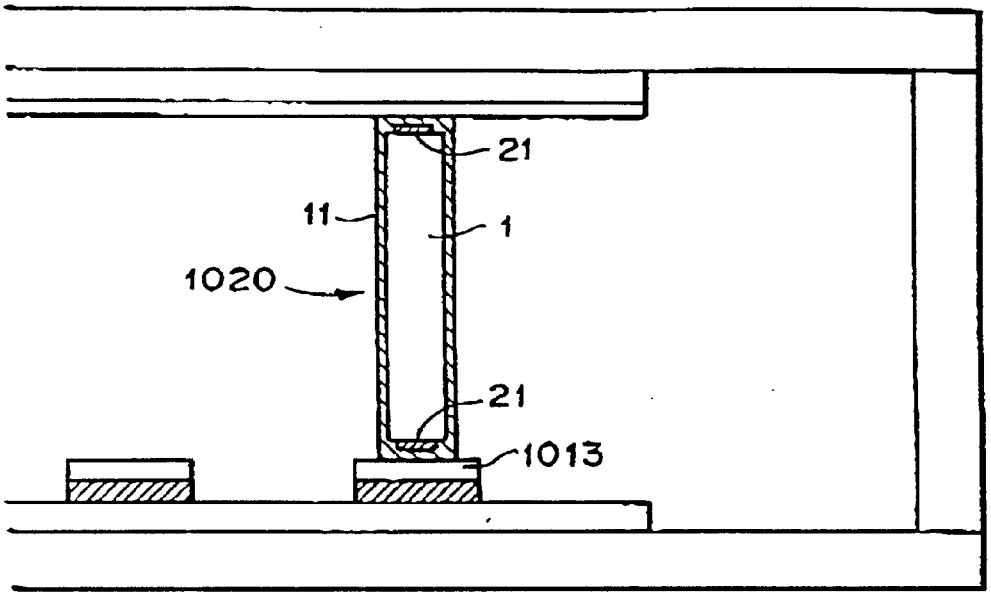
FIG. 7 is a cross-sectional view showing a display panel in accordance with a fourth embodiment of the present invention.

However, the present invention is not limited to the above structure. A structure in which the high resistant film 11 is coated on the low resistant film 21 may be applied. This structure is shown in FIG. 7. Similarly, in this structure, the action of relaxing the unevenness of the potential of the spacer is obtained. Also, even if the high resistant film 11 is intervened between the low resistant film 21 and the wiring 1013 which is an electrode disposed on the electron source and the metal back 1019 which is an accelerating electrode disposed on the face plate, since the electric resistance between the low resistant film 21 and the wiring 1013 which is the electrode disposed on the electron source or the metal back 1019 which is the accelerating electrode disposed on the face plate is a resistance in the thickwise direction of the high resistant film 11, the electric connection is realized.

Embodiment 5

Figure 8:
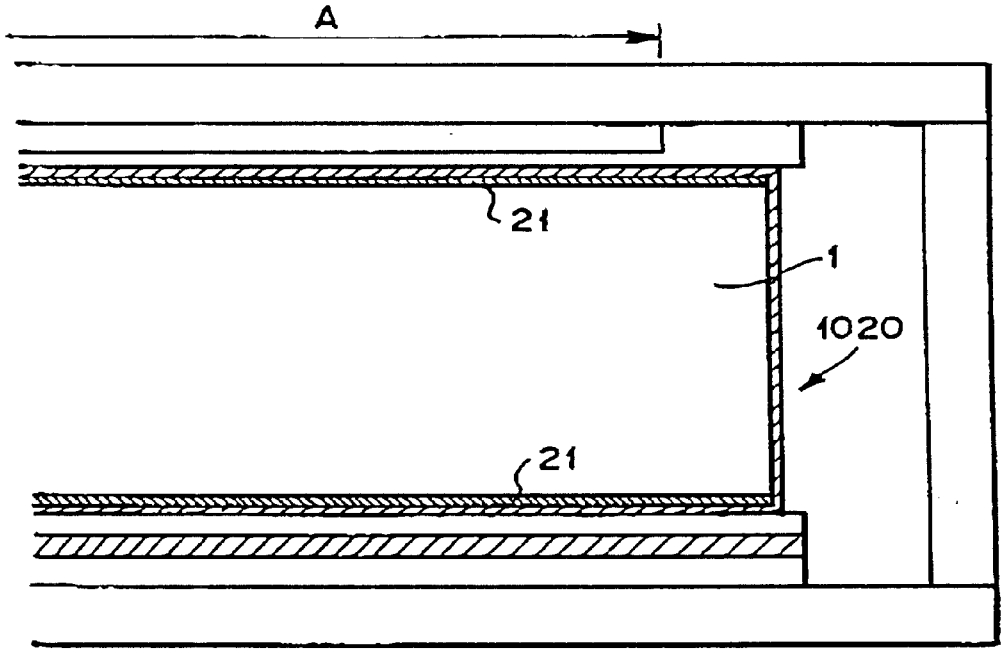
FIG. 8 is a side view showing a display panel in accordance with a fifth embodiment of the present invention.
Figure 9:
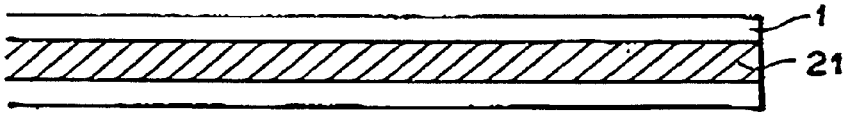
FIG. 9 is a diagram showing a positional relationship of a spacer when being viewed from a substrate side in accordance with the fifth embodiment of the present invention.

As shown in FIGS. 8 and 9, in the case where the length of the spacer is larger than the display region width A, it is possible that the low resistant film 21 extends up to an end surface of the spacer in the longitudinal direction of the spacer.

The reason is stated below.

Even if the low resistant film 21 extends up to an end surface of the spacer in the longitudinal direction of the spacer, the end portion of the low resistant film is positioned outside the display region. It is difficult to discharge the electricity since it is hard that the reflected electrons from the face plate reach the outside of the display region. Inside the display region, as shown in FIG. 9 corresponding to FIG. 2 as described in the embodiment 1, the low resistant film 21 is disposed inside the abutting surface region of the spacer, to thereby suppress the electric discharge within the display region.

In other words, in implementation of the present invention, it is desirable that in a region to which a high electric field (an electric field where electric discharge by the electrode on the end portion of the spacer can be generated) due to an acceleration voltage, which is a potential difference between an acceleration potential and a potential for driving the electron source is formed between upper and lower ends of the spacer. At a region to which such high electric field is formed, the electrode disposed along the spacer end portion is disposed inside a region of a surface of the end portion of the spacer which is directed toward the electron source side and/or the member to which the electron source is irradiated (or the control electrode such as the accelerating electrode). However, for example, even in a region which is outside the display region where the accelerating voltage is not applied to the upper and lower portion of the spacer, or in a region to which the high electric field is applied regardless of the inside or outside of the display region, if an influence of the electric discharge can be permitted, the above conditions do not always need to be satisfied.

Figure 10:
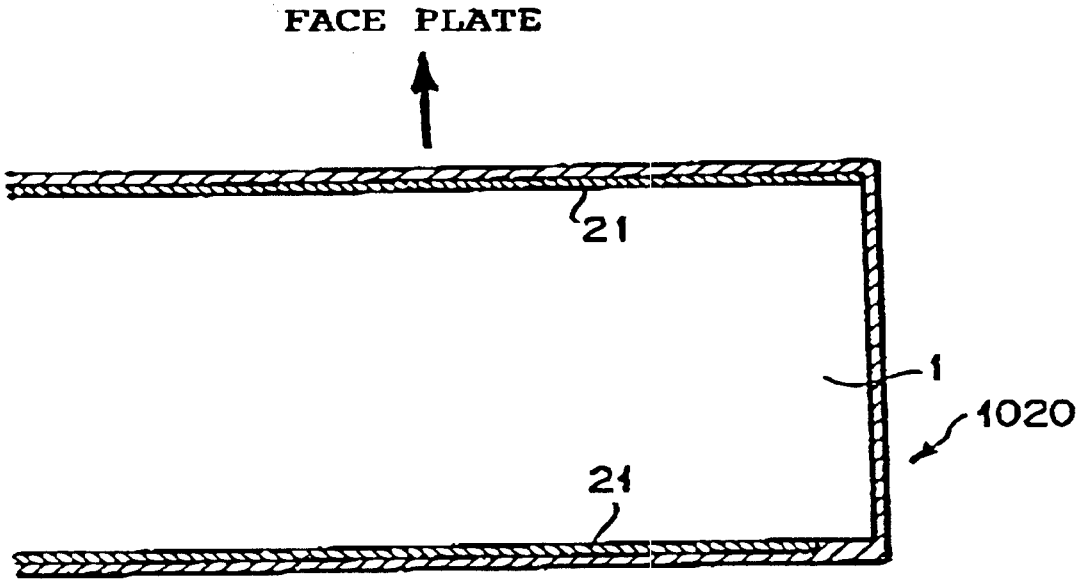
FIG. 10 is a side view showing a display panel in accordance with the fifth embodiment of the present invention.
Figure 11:
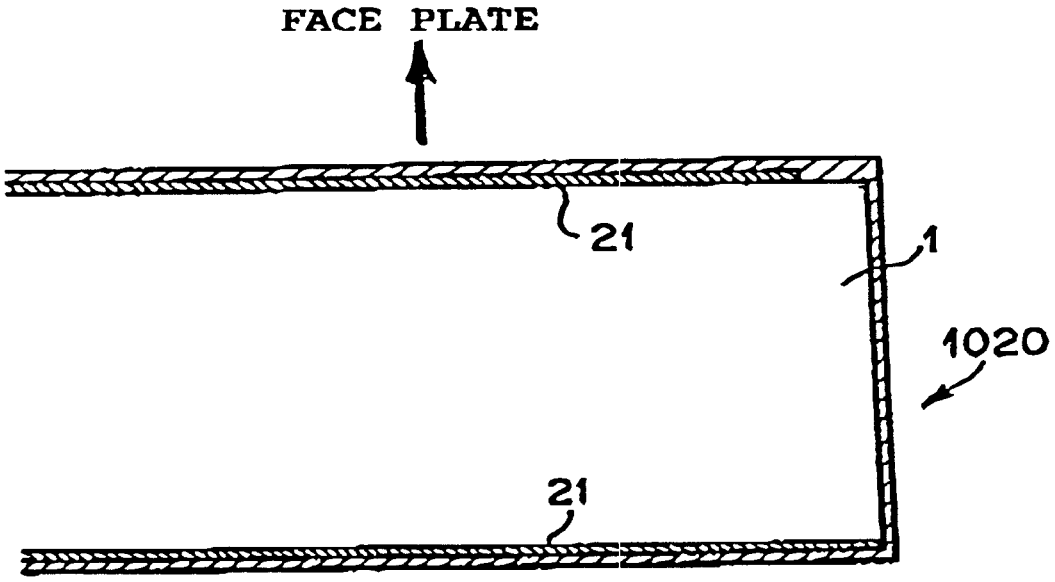
FIG. 11 is a side view showing a display panel in accordance with the fifth embodiment of the present invention.

Also, as shown in FIGS. 10 and 11, a structure may be applied in which any one of the low resistant film 21 on the face plate side and the low resistant film 21 on the electron source side extend up to the end portion of the spacer in the longitudinal direction thereof.

Figure 12:
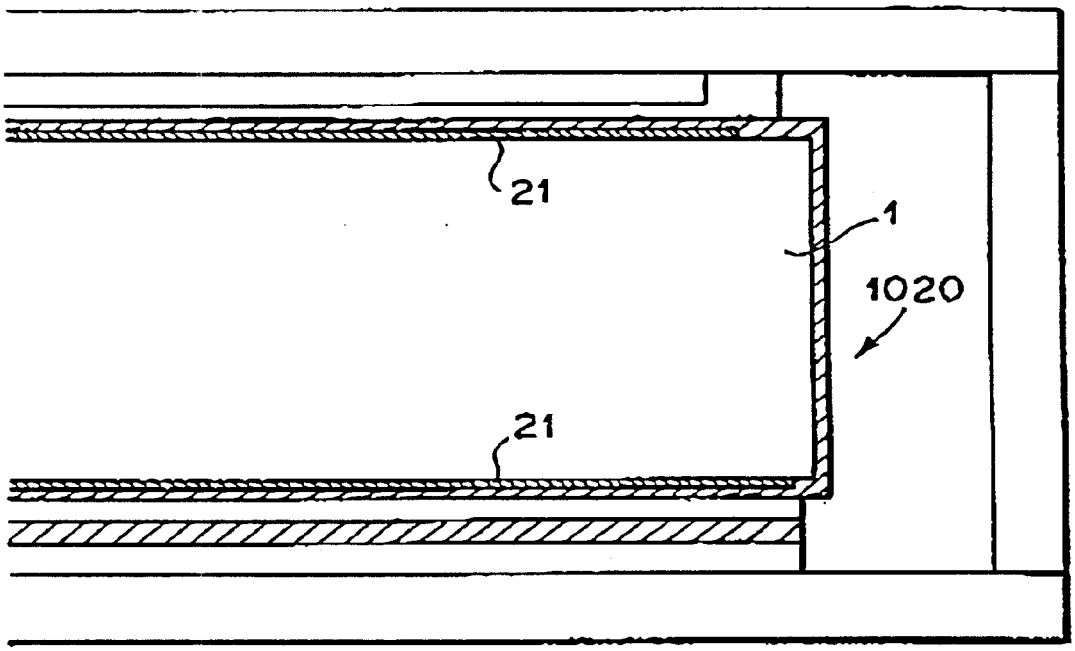
FIG. 12 is a side view showing a display panel in accordance with the fifth embodiment of the present invention.

Further, as shown in FIG. 12, the respective lengths of the low resistant film 21 on the face plate side and the low resistant film 21 on the face plate side and the low resistant film 21 on the electron source side along the longitudinal direction of the spacer may be so set as to satisfy the following condition.

The length of the low resistant film on the electron source side>The length of the low resistant film on the face plate side)

Embodiment 6

This embodiment shows a structure in which the longitudinal direction of the spacer is substantially in parallel with the direction of the normal of the substrate of the electron source.

Figure 13:
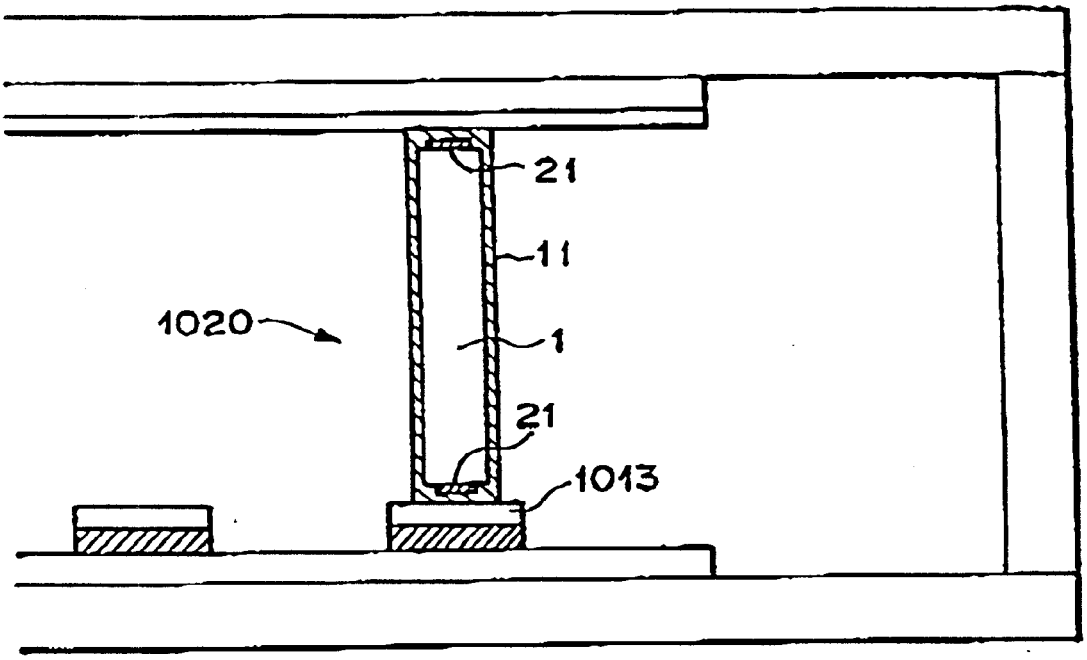
FIG. 13 is a cross-sectional view showing a display panel in accordance with a sixth embodiment of the present invention.

FIG. 13 is a cross-sectional view showing a display panel taken along an arbitrary surface that passes the center axis of a columnar insulating member.

The spacer 1020 is formed of a columnar insulating member 1, which is formed of a member where the low resistant film 21 is formed on an inner surface of the face plate of the columnar insulating member 1 and a surface of the face plate which is abutted against the surface of the electron source substrate (the low-directional wirings or the column-directional wirings), and the high resistant film 11 is formed on the surface of the insulating member 1.

The spacers 1020 are disposed on the row-directional wirings at regular intervals and electrically connected to the row-directional wirings.

Figure 14:
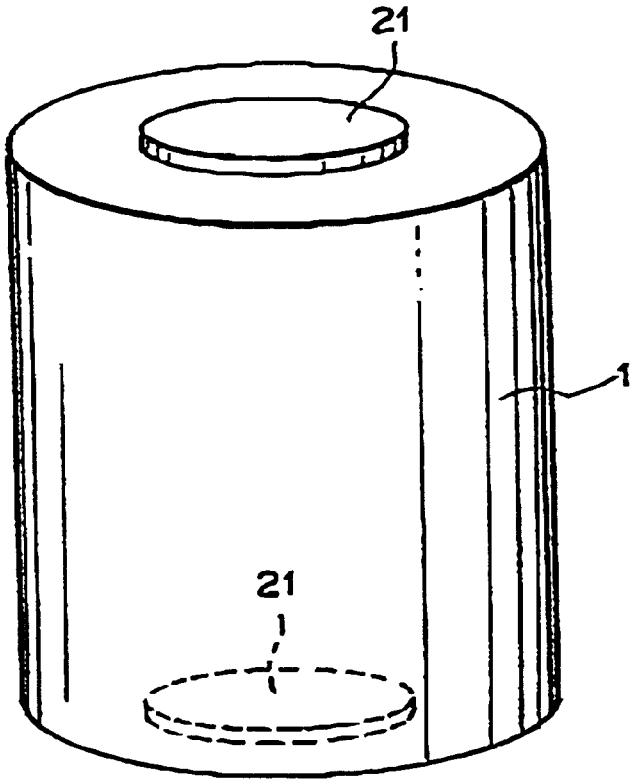
FIG. 14 is a perspective view showing a spacer in accordance with the sixth embodiment of the present invention.

In this example, the low resistant film 21 is electrically connected to the row-direction wirings through the high resistant film 11, and its arranging region is so structured as to be completely included in the abutting surface region of the spacer 1020 as shown in FIG. 14.

In the structure of this embodiment, the electric charges are not moved in the longitudinal direction of the spacer by the low resistant film 21, but it is preferable that the low resistant film 21 which serves as the electrode which uniforms the potential of the spacers, is disposed on 20% or more of the area of the region of the abutting surface of the spacer which is substantially directed toward the electron source side or the face plate side.

INDUSTRIAL APPLICABILITY

As was described above, according to the present invention, since the abutting surfaces of the joining material and the low resistant layer are all included in the abutting surface of the spacer, the electric discharge due to the concentration of the electric field onto the low resistant layer can be prevented.

Also, since the orthogonal projection of the joining material and the low resistant layer in a perpendicular direction of the electron source surface and the electrode surface are completely included within the orthogonal projection of the spacer, the vicinity of the electron source surface of the spacer is negatively charged by the direct incidence of the electric field emission electrons from the joining material and the low resistant film, to weaken the electric field of the lower-resistant layer and the vicinity of a contact point of the spacer and the electron source surface, thereby being capable of preventing the electric discharge.

What is claimed is:

1. An electron beam device comprising an electron source having an electron-emitting device, a member to be irradiated with an electron beam disposed opposite to said electron source, and an electrically conductive spacer disposed between said electron source and said member to be irradiated with the electron beam, wherein an electrode is disposed between an end portion of said spacer on said electron source side and said electron source, and an end portion of said electrode on said spacer side is disposed inside a region of a surface of the end portion of said spacer.

2. An electron beam device according to claim 1, wherein said spacer is electrically connected to an electrode disposed on said member to be irradiated with the electron beam.

3. An electron beam device comprising an electron source having an electron-emitting device, a control electrode disposed opposite to said electron source, to which a potential that controls electrons emitted from said electron source is given, and an electrically conductive spacer disposed between said electron source and said control electrode, wherein an electrode is disposed between an end portion of said spacer on said electron source side and said electron source, and an end portion of said electrode on said spacer side is disposed inside a region of a surface of the end portion of said spacer.

4. An electron beam device according to any of claims 1 to 3, wherein said spacer is electrically connected to the electrode constituting said electron source.

5. An electron beam device according to any of claims 1 to 3, wherein the electrode between an end portion of said spacer on said electron source side and said electron source comprises an electrode disposed on said spacer.

6. An electron beam device according to any of claims 1 to 3, wherein the electrode between an end portion of said spacer on said electron source side and said electron source comprises a joining material that fixes said spacer to said electron source side.

7. An electron beam device comprising an electron source having an electron-emitting device, a member to be irradiated with an electron beam disposed opposite to said electron source, and an electrically conductive spacer disposed between said electron source and said member to be irradiated with the electron beam, wherein an electrode is disposed between an end portion of said spacer on a side of said member to be irradiated with the electron beam and said member, and an end portion of said electrode on said spacer side is disposed inside a region of a surface of the end portion of said spacer.

8. An electron beam device according to claim 7, wherein said spacer is electrically connected to an electrode disposed on said member to be irradiated with the electron beam.

9. An electron beam device comprising an electron source having an electron-emitting device, a control electrode disposed opposite to said electron source, to which a potential that controls electrons emitted from said electron source is given, and an electrically conductive spacer disposed between said electron source and said control electrode, wherein an electrode is disposed between an end portion of said spacer on said control electrode side and said control electrode, and an end portion of said electrode on said spacer side is disposed inside a region of a surface of the end portion of said spacer.

10. An electron beam device according to claim 9, wherein said spacer is electrically connected to said control electrode.

11. An electron beam device according to any of claims 7 to 10, wherein said spacer is electrically connected to the electrode constituting said electron source.

12. An electron beam device according to claim 7 or 8, wherein the electrode between an end portion of said spacer on a side of said member and said member comprises an electrode disposed on said spacer.

13. An electron beam device according to claim 7 or 8, wherein the electrode between an end portion of said spacer on a side of said member and said member comprises a joining material that fixes said spacer to the side of said member to be irradiated with the electron beam.

14. An electron beam device according to claim 9 or 10, wherein the electrode between an end portion of said spacer on a side of said control electrode and said control electrode comprises a joining material that fixes said spacer to said control electrode side.

15. An electron beam device according to any of claims 1–3, wherein said spacer includes an electrically conductive film, and said electrically conductive film is electrically connected to the electrode between an end portion of said spacer on said electron source side and said electron source.

16. An electron beam device according to any of claims 1–3, wherein said spacer includes an electrically conductive film, and said electrically conductive film is in contact with the electrode between an end portion of said spacer on said electron source side and said electron source.

17. An electron beam device according to claim 15, wherein said electrically conductive film is laminated on the electrode disposed between an end portion of said spacer on said electron source side and said electron source.

18. An electron beam device according to claim 15, wherein said electrically conductive film is disposed on a base material that constitutes said spacer.

19. An electron beam device according to any of claims 1–3, 7, 8, 9, or 10, wherein said electron source includes a plurality of said electron-emitting devices.

20. An electron beam device according to claim 19, wherein said plurality of electron-emitting devices are wired in a matrix by a plurality of row-directional wirings and a plurality of column-directional wirings extending in a direction crossing said row-directional wirings.

21. An electron beam device according to any of claims 1–3, 7, 8, 9, or 10, wherein said electron-emitting device comprises a cold cathode element.

22. An image forming apparatus wherein, in the electron beam device according to any of claims 1–3, 7, 8, 9, or 10, there is provided a target onto which electrons emitted from said electron-emitting device are irradiated, and the electrons are irradiated onto said target to form an image.

23. An image forming apparatus according to claim 22, wherein said target comprises a phosphor.

24. An electron beam device according claim 9 or 10, wherein the electrode between an end portion of said spacer on a side of said control electrode and said control electrode comprises an electrode disposed on said spacer.

25. An electron beam device according to claim 7 or 8, wherein said spacer includes an electrically conductive film, and said electrically conductive film is electrically connected to the electrode between an end portion of said spacer on a side of said member to be irradiated with the electron beam and said member.

26. An electron beam device according to claim 9 or 10, wherein said spacer includes an electrically conductive film, and said electrically conductive film is electrically connected to the electrode between an end portion of said spacer on said control electrode side and said control electrode.

27. An electron beam device according to claim 7 or 8, wherein said spacer includes an electrically conductive film, and said electrically conductive film is in contact with the electrode between an end portion of said spacer on a side of said member to be irradiated with the electron beam and said member.

28. An electron beam device according to claim 9 or 10, wherein said spacer includes an electrically conductive film, and said electrically conductive film is in contact with the electrode between and end portion of said spacer on said control electrode side and said control electrode.

29. An electron beam device according to claim 25, wherein said electrically conductive film is laminated on the electrode disposed between an end portion of said spacer on a side of said member to be irradiated with the electron beam and said member.

30. An electron beam device according to claim 26, wherein said electrically conductive film is laminated on the electrode disposed between an end portion of said spacer on said control electrode side and said control electrode.

31. An electron beam device according to claim 27, wherein said electrically conductive film is laminated on the electrode disposed between an end portion of said spacer on a side of said member to be irradiated with the electron beam and said member.

32. An electron beam device according to claim 28, wherein said electrically conductive film is laminated on the electrode disposed between an end portion of said spacer on said control electrode side and said control electrode.

33. An electron beam device according to claim 16, wherein said electrically conductive film is disposed on a base material that constitutes said spacer.

34. An electron beam device according to claim 17, wherein said electrically conductive film is disposed on a base material that constitutes said spacer.

35. An electron beam device according to claim 25, wherein said electrically conductive film is disposed on a base material that constitutes said spacer.

36. An electron beam device according to claim 26, wherein said electrically conductive film is disposed on a base material that constitutes said spacer.

37. An electron beam device according to claim 27, wherein said electrically conductive film is disposed on a base material that constitutes said spacer.

38. An electron beam device according to claim 28, wherein said electrically conductive film is disposed on a base material that constitutes said spacer.

39. An electron beam device according to claim 29, wherein said electrically conductive film is disposed on a base material that constitutes said spacer.

40. An electron beam device according to claim 30, wherein said electrically conductive film is disposed on a base material that constitutes said spacer.

41. An electron beam device comprising an electron source having an electron-emitting device, a member to be irradiated with an electron beam disposed opposite to said electron source, and an electrically conductive spacer disposed between said electron source and said member to be irradiated with the electron beam, wherein a metal is disposed at at least one of a position between an end portion of said spacer adjacent said electron source and said electron source, and a position between said member and another end portion of said spacer adjacent said member, and wherein an end portion of said metal, adjacent said spacer, is disposed inside a region of a surface of the end portion of said spacer.

42. An electron beam device comprising an electron source having an electron-emitting device, a control electrode disposed opposite to said electron source, to which a control potential that controls electrons emitted from said electron source is given, and an electrically conductive spacer disposed between said electron source and said control electrode, wherein a metal is disposed at at least one of a position between an end portion of said spacer adjacent said electron source and said electron source and a position between an end portion of said spacer adjacent said control electrode and said control electrode, and wherein an end portion of said metal, adjacent said spacer, is disposed inside a region of a surface of the end portion of said spacer.

43. An electron beam device comprising an electron source having an electron-emitting device, a control electrode disposed opposite to said electron source, to which an acceleration potential that accelerates electrons emitted from said electron source is given, and an electrically conductive spacer disposed between said electron source and said control electrode, wherein an electrode is disposed at at least one of a position between an end potion of said spacer adjacent said electron source and said electron source and a position between an end portion of said spacer adjacent said control electrode and said control electrode, and wherein an end portion of said electrode, adjacent said spacer and within a region to which a higher potential is applied due to the acceleration potential, is disposed inside a region of a surface of the end portion of said spacer.

44. An electron beam device comprising an electron source having an electron-emitting device, a control electrode disposed opposite to said electron source, to which an acceleration potential that accelerates electrons emitted from said electron source is given, and an electrically conductive spacer disposed between said electron source and said control electrode, wherein a metal is disposed at at least one of a position between an end portion of said spacer adjacent said electron source and said electron source and a position between an end portion of said spacer adjacent said control electrode and said control electrode, and wherein an end portion of said metal, adjacent said spacer and within a region to which a higher potential is applied due to the acceleration potential, is disposed inside a region of a surface of the end portion of said spacer.

45. An electron beam device according to any one of claims 41–44, wherein said spacer has an electrically conductive film.

* * * * *

UNITED STATES PATENT AND TRADEMARK OFFICE

CERTIFICATE OF CORRECTION

PATENT NO. : 6,534,911 B1 
DATED : March 18, 2003
INVENTOR(S) : Yoichi Ando

It is certified that error appears in the above-identified patent and that said Letters Patent is hereby corrected as shown below:

Drawings,
Sheet 17, Figure 25, “DISPALY” should read -- DISPLAY --.

Column 1,
Line 38, “an” should read -- and --.

Column 3,
Line 53, “of” should be deleted.

Column 4,
Line 3, “are” should read -- is --.

Column 9,
Line 11, “flit” should read -- frit --; and
Line 29, “element” should read -- elements --.

Column 10,
Line 48, “as as” should read -- as an --.

Column 11,
Line 52, “reproductibility” should read -- reproducibility --.

Column 13,
Line 54, “flit” should read -- frit --.

Column 14,
Line 26, “can not” should read -- cannot be --.

Column 15,
Line 53, “0.1 [kV] to 10 [Kv].” should read -- 0.1 kV to 10 kV. --.

Column 16,
Line 46, “are” should read -- is --.

Column 17,
Line 4, “metal,” should read -- metals, --; and
Line 28, “are” should read -- is --.

UNITED STATES PATENT AND TRADEMARK OFFICE

CERTIFICATE OF CORRECTION

PATENT NO. : 6,534,911 B1
DATED : March 18, 2003
INVENTOR(S) : Yoichi Ando

It is certified that error appears in the above-identified patent and that said Letters Patent is hereby corrected as shown below:

Column 18,
Line 67, “elements” should read -- element --.

Column 19,
Line 8, “method,.” should read -- method. --; and
Line 34, “is” should read -- are --.

Column 23,
Line 4, “shown” should read -- shows -- and “cross-section” should read -- cross section --; and
Line 7, “such a manner where” should read -- a manner in which --.

Column 27,
Line 55, “reserve” should read -- reverse --.

Column 28,
Line 15, “mentioned” should read -- method --; and
Line 44, “operation is” should read -- operations are --.

Column 30,
Line 13, “by” should read -- be effected by --;
Line 23, “cross-section” should read -- cross section --; and
Line 30, “applied to.” should read -- applied. --.

Column 31,
Line 45, “film 21 on the face plate side and the low resistant” should be deleted; and
Line 51, “side)” should read -- side --.

Column 32,
Line 14, “uni-” should read -- makes uniform --.

Column 34,
Line 42, “and” should read -- an --.

UNITED STATES PATENT AND TRADEMARK OFFICE

CERTIFICATE OF CORRECTION

PATENT NO. : 6,534,911 B1 
DATED : March 18, 2003
INVENTOR(S) : Yoichi Ando

It is certified that error appears in the above-identified patent and that said Letters Patent is hereby corrected as shown below:

Column 36,
Line 12, "potion" should read -- portion --.

Signed and Sealed this

Ninth Day of December, 2003

JAMES E. ROGAN
*Director of the United States Patent and Trademark Office*